US010874191B2

(12) United States Patent
Oh et al.

(10) Patent No.: US 10,874,191 B2
(45) Date of Patent: Dec. 29, 2020

(54) COSMETIC CONTAINER

(71) Applicant: LG HOUSEHOLD & HEALTH CARE LTD., Seoul (KR)

(72) Inventors: Se Woong Oh, Cheongju-si (KR); Hyeon Jeong Kim, Cheongju-si (KR); Hye Ryen Kim, Seoul (KR); Sang Wook Park, Daejeon (KR); Jae Hong Jung, Seoul (KR); Kyungwon Kim, Seoul (KR); Ye Kyung Cho, Seoul (KR); Sung-Tae Kim, Seoul (KR); Guyong Lee, Seoul (KR); Sungsoo Kang, Daejeon (KR); In Hwan Roh, Anyang-si (KR)

(73) Assignee: LG HOUSEHOLD & HEALTH CARE LTD., Seoul (KR)

( * ) Notice: Subject to any disclaimer, the term of this patent is extended or adjusted under 35 U.S.C. 154(b) by 144 days.

(21) Appl. No.: 15/995,681

(22) Filed: Jun. 1, 2018

(65) Prior Publication Data

US 2018/0279741 A1 Oct. 4, 2018

Related U.S. Application Data

(63) Continuation of application No. 15/024,529, filed as application No. PCT/KR2015/001103 on Feb. 3, 2015, now Pat. No. 10,426,246.

(30) Foreign Application Priority Data

Feb. 14, 2014 (KR) ..... 10-2014-0017013
Jul. 22, 2014 (KR) ..... 10-2014-0092736
(Continued)

(51) Int. Cl.
*A45D 33/02* (2006.01)
*A45D 40/00* (2006.01)
(Continued)

(52) U.S. Cl.
CPC ..... *A45D 40/0075* (2013.01); *A45D 33/006* (2013.01); *A45D 33/008* (2013.01);
(Continued)

(58) Field of Classification Search
CPC .. A45D 40/22; A45D 40/0075; A45D 33/006; A45D 33/008; A45D 33/02;
(Continued)

(56) References Cited

U.S. PATENT DOCUMENTS 4,982,751 A 1/1991 Oishi et al.
5,548,085 A 8/1996 Flores
(Continued)

FOREIGN PATENT DOCUMENTS

CN 60-97513 U 7/1985
CN 1165768 A 11/1997
(Continued)

OTHER PUBLICATIONS

[Reporter: Jin Woo Kim of E-Daily], "LG Household & Health Care Ltd. selects a 'former Wonder Girls member', So Hee Ahn, for the new VDL model", E-Daily, Feb. 12, 2016, 2 pages., URL: http://www.edaily.co.kr/news/NewsRead.edy?SCD=JC21&newsid=01423526612549864&DCD=A00302&.
(Continued)

*Primary Examiner* — Rachel R Steitz
(74) *Attorney, Agent, or Firm* — Birch, Stewart, Kolasch & Birch, LLP

(57) ABSTRACT

The present disclosure relates to a cosmetic vessel. The cosmetic vessel includes a discharge unit discharging cosmetics to an outside, and a discharge plate provided at one side of the discharge unit from which the cosmetics are discharged, the discharge plate including a plurality of discharge holes, wherein the cosmetics are discharged through the plurality of discharge holes of the discharge
(Continued)

plate, and a thin film is formed on one surface of the discharge plate exposed to the outside.

29 Claims, 21 Drawing Sheets

(30) Foreign Application Priority Data

| | | |
|---|---|---|
| Jul. 22, 2014 | (KR) | 10-2014-0092737 |
| Jul. 22, 2014 | (KR) | 10-2014-0092738 |
| Jul. 22, 2014 | (KR) | 10-2014-0092739 |
| Jul. 22, 2014 | (KR) | 10-2014-0092740 |
| Aug. 12, 2014 | (KR) | 10-2014-0104488 |

(51) Int. Cl.

| | |
|---|---|
| ***A45D 34/00*** | (2006.01) |
| ***A45D 33/00*** | (2006.01) |
| ***A45D 33/06*** | (2006.01) |
| ***A45D 40/22*** | (2006.01) |
| ***B05B 11/00*** | (2006.01) |

(52) U.S. Cl.
CPC ..... *A45D 33/02* (2013.01); *A45D 33/06* (2013.01); *A45D 34/00* (2013.01); *A45D 40/22* (2013.01); *B05B 11/3001* (2013.01); *A45D 2200/055* (2013.01); *A45D 2200/056* (2013.01); *A45D 2200/1018* (2013.01); *A45D 2200/155* (2013.01)

(58) Field of Classification Search
CPC .. A45D 33/06; A45D 34/00; A45D 2200/005; A45D 2200/056; A45D 2200/1018; A45D 2200/155; B05B 11/3001
See application file for complete search history.

(56) References Cited

U.S. PATENT DOCUMENTS

| | | | |
|---|---|---|---|
| 5,762,946 | A | 6/1998 | Gueret |
| 8,021,064 | B2 | 9/2011 | Gueret |
| 8,021,069 | B2 | 9/2011 | Baghdasarian |
| 10,010,153 | B2 | 7/2018 | Kim et al. |
| 2003/0213723 | A1 | 11/2003 | Lombardi |
| 2005/0109363 | A1 | 5/2005 | Matsuoka |
| 2007/0205233 | A1 | 9/2007 | Petit et al. |
| 2008/0190444 | A1 | 8/2008 | Bennett |
| 2008/0264440 | A1 | 10/2008 | Thorpe |
| 2008/0279616 | A1 | 11/2008 | Thorpe |
| 2009/0188517 | A1 | 7/2009 | Thorpe et al. |
| 2011/0278328 | A1 | 11/2011 | Kang |
| 2012/0125361 | A1 | 5/2012 | Yeom |
| 2012/0305606 | A1 | 12/2012 | Lee et al. |
| 2014/0014659 | A1 | 1/2014 | Thorpe et al. |
| 2014/0069840 | A1 | 3/2014 | Park |
| 2014/0291351 | A1 | 10/2014 | Kang |
| 2015/0079802 | A1 | 3/2015 | Wen |
| 2015/0079862 | A1 | 3/2015 | Jeong et al. |
| 2015/0217313 | A1 | 8/2015 | Kim et al. |
| 2015/0230586 | A1 | 8/2015 | Thorpe |
| 2016/0015149 | A1 | 1/2016 | Kim et al. |
| 2016/0073761 | A1 | 3/2016 | Lee |
| 2016/0073762 | A1 | 3/2016 | Lee |
| 2016/0136666 | A1 | 5/2016 | Kang |
| 2016/0242529 | A1 | 8/2016 | Oh et al. |
| 2016/0303502 | A1 | 10/2016 | Kang |

FOREIGN PATENT DOCUMENTS

| | | | |
|---|---|---|---|
| CN | 1183252 | A | 6/1998 |
| CN | 1254302 | A | 5/2000 |
| CN | 2618488 | Y | 6/2004 |
| CN | 1921784 | A | 2/2007 |
| CN | 200969917 | Y | 10/2007 |
| CN | 201029548 | Y | 3/2008 |
| CN | 10130114 | A | 11/2008 |
| CN | 201192162 | Y | 2/2009 |
| CN | 201260473 | Y | 6/2009 |
| CN | 101779858 | A | 7/2010 |
| CN | 201743143 | U | 2/2011 |
| CN | 102088886 | A | 6/2011 |
| CN | 201647054 | U | 6/2011 |
| CN | 202890958 | U | 4/2013 |
| CN | 203399790 | U | 1/2014 |
| HK | 2001-292827 | A | 10/2001 |
| JP | 59-25704 | A | 2/1984 |
| JP | 59-184709 | U | 12/1984 |
| JP | 62-127216 | U | 8/1987 |
| JP | 64-043819 | U | 3/1989 |
| JP | 1-72818 | U | 5/1989 |
| JP | 1-091423 | U | 6/1989 |
| JP | 1-134924 | U | 11/1989 |
| JP | 1-164922 | U | 11/1989 |
| JP | 4-91888 | U | 8/1992 |
| JP | 5-10743 | Y2 | 3/1993 |
| JP | 5-23135 | Y2 | 6/1993 |
| JP | 6-1082 | Y2 | 1/1994 |
| JP | 6-002605 | Y2 | 1/1994 |
| JP | 8-158940 | A | 6/1996 |
| JP | 2541593 | Y2 | 7/1997 |
| JP | 10-52315 | A | 2/1998 |
| JP | 10-194308 | A | 7/1998 |
| JP | 8-338418 | A | 12/1998 |
| JP | 3061178 | U | 6/1999 |
| JP | 2000-129448 | A | 5/2000 |
| JP | 2001-19055 | A | 1/2001 |
| JP | 2002-10827 | A | 10/2001 |
| JP | 2003-116631 | A | 4/2003 |
| JP | 2003-210245 | A | 7/2003 |
| JP | 2003-275660 | A | 9/2003 |
| JP | 3452688 | B2 | 9/2003 |
| JP | 2004-208975 | A | 7/2004 |
| JP | 3765897 | B2 | 4/2006 |
| JP | 3853952 | B2 | 12/2006 |
| JP | 3987272 | B2 | 10/2007 |
| JP | 4129175 | B2 | 8/2008 |
| JP | 2009-11801 | A | 1/2009 |
| JP | 4338383 | B2 | 10/2009 |
| JP | 4590593 | B2 | 12/2010 |
| JP | 4738026 | B2 | 8/2011 |
| JP | 2012-206774 | A | 10/2012 |
| JP | 5115956 | B2 | 1/2013 |
| JP | 2013-116192 | A | 6/2013 |
| KR | 20-0370308 | Y1 | 12/2004 |
| KR | 20-0372911 | Y1 | 1/2005 |
| KR | 20-0383969 | Y1 | 5/2005 |
| KR | 10-0591522 | B1 | 6/2005 |
| KR | 20-0402606 | Y1 | 12/2005 |
| KR | 20-0416630 | Y1 | 5/2006 |
| KR | 10-0751835 | B1 | 8/2007 |
| KR | 10-0778286 | B1 | 11/2007 |
| KR | 10-0781747 | B1 | 12/2007 |
| KR | 10-0841441 | B1 | 6/2008 |
| KR | 10-1171305 | B1 | 8/2010 |
| KR | 20-0450515 | Y1 | 10/2010 |
| KR | 20-0453355 | Y1 | 4/2011 |
| KR | 10-2011-0083318 | A | 6/2011 |
| KR | 20-2011-0008182 | U | 6/2011 |
| KR | 10-1103188 | B1 | 1/2012 |
| KR | 20-2012-0000763 | U | 2/2012 |
| KR | 20-0459637 | Y1 | 4/2012 |
| KR | 10-1157218 | B1 | 7/2012 |
| KR | 10-1159135 | B1 | 7/2012 |
| KR | 20-0461424 | Y1 | 7/2012 |
| KR | 20-0461897 | Y1 | 8/2012 |
| KR | 10-2013-0043567 | A | 4/2013 |
| KR | 10-1255161 | B1 | 4/2013 |
| KR | 10-2013-0048082 | A | 5/2013 |
| KR | 20-0467991 | Y1 | 7/2013 |
| KR | 10-2013-011614 | A | 10/2013 |
| KR | 20-2013-0008083 | U | 10/2013 |

(56) References Cited

FOREIGN PATENT DOCUMENTS

| | | | |
|---|---|---|---|
| KR | 20-0470006 | Y1 | 11/2013 |
| KR | 10-1355364 | B1 | 1/2014 |
| KR | 20-0470757 | Y1 | 1/2014 |
| KR | 10-1429089 | B1 | 8/2014 |
| KR | 10-2014-0121797 | A | 10/2014 |
| KR | 20-2014-0005481 | U | 10/2014 |
| KR | 20-2014-0005553 | U | 10/2014 |
| KR | 10-2014-0146882 | A | 12/2014 |
| KR | 20-2015-0000353 | U | 1/2015 |
| KR | 20-0475944 | Y1 | 1/2015 |
| KR | 10-1494188 | B1 | 2/2015 |
| KR | 20-0476239 | Y1 | 2/2015 |
| KR | 10-2015-0087772 | A | 7/2015 |
| KR | 10-2015-0096602 | A | 8/2015 |
| KR | 10-2015-0096608 | A | 8/2015 |
| KR | 20-0478242 | Y1 | 9/2015 |
| KR | 10-1597076 | B1 | 2/2016 |
| KR | 20-2017-0000470 | U | 2/2017 |
| KR | 10-2008-0042196 | A | 4/2018 |
| WO | WO 2005/082200 | A1 | 9/2005 |
| WO | WO 2006/033559 | A1 | 3/2006 |
| WO | WO 2008/007832 | A1 | 1/2008 |
| WO | WO 2011/068369 | A2 | 6/2011 |
| WO | WO 2014/014198 | A1 | 1/2014 |
| WO | WO 2015/056902 | A1 | 4/2015 |
| WO | WO 2015/072732 | A1 | 5/2015 |
| WO | WO 2015/088100 | A1 | 6/2015 |

OTHER PUBLICATIONS

[Reporter: Su Jin Park of Sisaon], "LG Household & Health Care Ltd. releases VDL Expert Metal Cushion Foundation", Sisaon, Mar. 2, 2016, 3 pages, URL: http://www.sisaon.co.kr/news/articleView.html?idxno=41862.

Korean Notice of Allowance, dated Mar. 26, 2019, for Korean Application No. 10-2018-0045161.

VDL Cosmetics, "VDL Meets So Hee", Feb. 18, 2016, 2 pages, URL: http://instagram.com/vdl_cosmetics.

"Mule ice foundcealer," BEAUTY+, Jul. 17, 2013, pp. 1-20 (21 pages total), with an English summary.

"Mule ice foundcealer," Ce'Ci, Jul. 25, 2013, pp. 1-7 (8 pages total), with an English summary.

Decision of Invalidation from Patent Appeal Board decided on Oct. 6, 2016 for Korean Patent No. 10-1471339, along with a English summary, 29 pages total.

English summary of Result of Invalidation Trial for Korean Patent No. 10-1566114, Nov. 2016, 1 page.

Invalidation Trial Request mailed Sep. 18, 2015, for Korean Patent No. 10-1471339 B1, 42 pages.

Invalidation Trial Request, mailed Jan. 22, 2016, for Korean Patent No. 10-1586114, 37 pages.

LG Household & Health Care, Announcement of product launch of "Beauty Metal Cushion Foundation with screenshots," Mar. 14, 2014, pp. 1-2 (Total 3 pages), along with an English translation.

Preparatory Pleadings of Appeal against Invalidatuon Trial with regard to KR-10-1471339-B1, dated Dec. 20, 2016, together with a partial English translation thereof.

Screenshot of a blog post describing a stainless steel type, Feb. 17, 2014, pp. 3-5 (Total 6 pages),along with a partial English translation.

Screenshots of an online shopping website selling a shower head using SUS, 7 pages, Oct. 2009, along with an English summary.

VDL, Blog screenshot regarding VDL Beauty Metal Cushion Foundation, pp. 1-2 and 7-11 (Total 13 pages), Mar. 31, 2014, along with an English summary.

VDL, Photographs of disassembly of VDL Beauty Metal Cushion Foundation, Mar. 2014, 6 pages, along with an English summary.

Web Site: ezday mania, "IOPE Retigen Smoothing Powder", Mar. 21, 2012, <http://www/ezday.co.kr/bbs/view_board.html?q_sq_board=3500546>, see p. 5, lines 1-4; first picture, second picture on p. 5.

Chinese Office Action, dated Oct. 30, 2020, for Chinese Patent Application No. 201810955605.4.

BEFORE USE AFTER USE

METAL (BEFORE USE)

PLASTIC (BEFORE USE)

METAL (AFTER USING 20 TIMES)

PLASTIC (AFTER USING 20 TIMES)

COSMETIC CONTAINER

CROSS-REFERENCE TO RELATED APPLICATIONS

This application is a Continuation of co-pending U.S. patent application Ser. No. 15/024,529 filed on Mar. 24, 2016, which is the National Phase of PCT International Application No. PCT/KR2015/001103 filed on Feb. 3, 2015, which claims priority to and the benefit of Korean Patent Application Nos. 10-2014-0017013 filed on Feb. 14, 2014, 10-2014-0092736 filed on Jul. 22, 2014, 10-2014-0092737 filed on Jul. 22, 2014, 10-2014-0092738 filed on Jul. 22, 2014, 10-2014-0092739 filed on Jul. 22, 2014, 10-2014-0092740 filed on Jul. 22, 2014, and 10-2014-0104488 filed on Aug. 12, 2014, the entire contents of all these applications are incorporated herein by reference.

TECHNICAL FIELD

Various embodiments of the present invention relate to a cosmetic vessel, and more particularly, to a cosmetic vessel wherein cosmetics may be discharged through a plurality of discharge holes formed on a discharge plate so that a user may rub the cosmetics on top of the discharge plate using a puff.

BACKGROUND ART

Solid cosmetics such as foundations or liquid cosmetics such as sun blocks which are in widespread use help to protect and lighten a user's skin and reduce wrinkles. The user may apply cosmetics onto a makeup puff and pat to spread the cosmetics on a user's face.

Cosmetics may be sold with a makeup puff received in a cosmetic vessel. Generally, the puff may be received in a lid of the cosmetic vessel. Therefore, to apply cosmetics, a user may open the lid to take the puff out, and press the puff onto the cosmetics with the user's fingers inserted under an elastic ribbon of the puff to pick up a predetermined amount of cosmetics.

However, when the user directly presses the puff onto the cosmetics, cosmetics more than the user needs may be applied to the puff by the pressure the user applies on the puff, which may cause wasting of the puff. Therefore, recently, a method has been developed in which a sponge is impregnated with liquid cosmetics and the liquid cosmetics permeated into the sponge is discharged and supplied to the puff when the user presses the sponge with the puff.

However, in the above-described conventional cosmetics vessel, cosmetics more than the user needs may be discharged to the puff by the pressure the user presses the sponge. In addition, when the user presses the sponge too hard by mistake, the cosmetics may be discharged to a portion of the puff adjacent to the user's fingers as well as the surface of the puff which directly touches the user's skin, which may cause considerable inconvenience to the user.

In addition, conventionally, when the user applies the cosmetics to the user's skin such as a face by tapping the puff holding the cosmetics from the cosmetics-impregnated sponge, the user repeats pressing the puff against the cosmetics-impregnated sponge to apply the cosmetics. In this manner, however, the cosmetics may be seriously contaminated with viruses, molds, or bacteria on the skin. Furthermore, the contaminated microorganism in the cosmetics may keep growing until the user uses up the cosmetics. As a result, such contamination causes skin stimulation, skin problems, skin allergies, smell change, and the like. If the user experiences such inconvenience, the user will avoid using the cosmetics. Although the user wishes to use the cosmetic product for beauty, the cosmetics may rather cause personal hygiene problems and skin problems. Therefore, the user may feel strongly dissatisfied with the cosmetics.

For safe storage and use of cosmetics to avoid contamination by microorganism, a vessel container may have a structure to prevent cosmetic contents from contacting external contaminants. In addition, while only a desired amount of cosmetics are used, the remaining cosmetics are to be safely kept without contamination by microorganism.

The solution and review for such structure are to be earnestly sought. Thus, recommendation for use of cosmetics for beauty without finding a fundamental solution to it may rather cause serious skin side effects.

PRIOR ART DOCUMENT (Cited reference 1) Korea Registration Publication No. 10-1355364 (published on Jan. 23, 2014)

DISCLOSURE

Technical Problem

Various embodiments of the present disclosure are directed to solve the aforementioned problems, and an object of the present disclosure is to provide a cosmetic vessel having a thin film on the one surface of the discharge plate in order to beautify the appearance.

Another object of the present disclosure is to provide a cosmetic vessel having at least one discharge hole on a discharge plate so that cosmetics may be discharged through the at least one discharge hole, and therefore minimizing contact between the cosmetics and air to improve hygiene.

Another object of the present disclosure is to provide a cosmetic vessel wherein a diffusion portion for guiding cosmetics to a discharge hole of a discharge plate is in close contact to the discharge plate, so as to prevent the cosmetics from leaking outside while at the same time minimize the residual amount of the cosmetics.

Another object of the present disclosure is to provide a cosmetic vessel having a simplified structure of a diffusion portion so that cosmetics may flow only to a diffusion space formed in the diffusion portion, thereby saving the manufacturing cost and facilitating discharging of the cosmetics.

Technical Solution

According to an embodiment, a cosmetic vessel may include a discharge unit discharging cosmetics to an outside, and a discharge plate provided at one side of the discharge unit from which the cosmetics are discharged, the discharge plate including a plurality of discharge holes, wherein the cosmetics are discharged through the plurality of discharge holes of the discharge plate, and a thin film is formed on one surface of the discharge plate exposed to the outside.

The thin film may cover portions between the plurality of discharge holes at one surface of the discharge plate.

The film may include a hole communicating with the discharge holes so that the cosmetics are discharged therethrough.

The thin film may have a smaller thickness than the discharge plate.

The thin film may have a thickness ranging from 1 micrometer to 50 micrometers.

The thin film may comprise at least one material selected from a group including gold, silver, bronze, copper, chromium, and hologram.

The discharge plate may be made of a nonmetallic material.

The cosmetics are discharged from the discharge unit by pressurizing the discharge plate.

The cosmetic vessel may further include an outer plate provided at one surface of the discharge plate from which the cosmetics are discharged through the discharge holes.

The outer plate may include a hole communicating with the discharge holes so that the cosmetics are discharged therethrough.

The discharge holes may be misaligned with an outlet of the discharge unit.

The cosmetic vessel may further include a diffusion portion provided between the discharge unit and the discharge plate and distributing the cosmetics to the discharge holes, and a rim portion moving downwards in conjunction with the discharge plate while fixing the discharge plate and the diffusion portion.

The rim portion may surround a rim of the discharge plate and be coupled to the diffusion portion.

The rim portion may be provided integrally with the discharge plate.

The diffusion plate may include a packing material for preventing the cosmetics from being leaked to an outside of the diffusion portion.

The rim portion may include an inner rim portion moving downwards in conjunction with the discharge plate while fixing the discharge plate and the diffusion portion, and an outer rim portion provided on an outside of the inner rim portion, wherein the outer rim portion restricts rotation of the inner rim portion, allows elevating and lowering thereof, and surrounds an outside of the inner rim portion.

Teeth may be formed on an inner surface of the outer rim portion and an outer surface of the inner rim portion to restrict the rotation of the inner rim portion and allow the elevating and lowering thereof.

The discharge unit may be an airless pump for discharging the cosmetics received therein to an outlet by using a piston moving up and down in a cylinder.

Advantageous Effects

A cosmetic vessel according to the present disclosure is provided with one surface of the discharge plate on which cosmetics are discharged is provided with a thin film so as to maximize beauty through the one surface of the discharge plate being exposed to outside.

Furthermore, a cosmetic vessel according to the present disclosure is provided with a very small hole formed on a discharge plate so that cosmetics may be discharged through that hole, and therefore keeping air from contacting the cosmetics stored in the vessel as much as possible to effectively prevent contamination of cosmetics such as generation of microorganism.

Furthermore, a cosmetic vessel according to the present disclosure is provided with a diffusion portion for delivering cosmetics from a discharge unit to a discharge hole of a discharge plate, the diffusion portion having a close contact surface for close contact with the discharge plate to prevent the cosmetics from leaking outside, thereby increasing user satisfaction.

Furthermore, a cosmetic vessel according to the present disclosure has a simplified structure wherein the diffusion portion is in close contact with the discharge plate, and thus it is possible to save the manufacturing cost and minimize the residual amount of cosmetics in the vessel and facilitate discharging of the cosmetics.

DETAILED DESCRIPTION OF THE INVENTION

Figure 1:
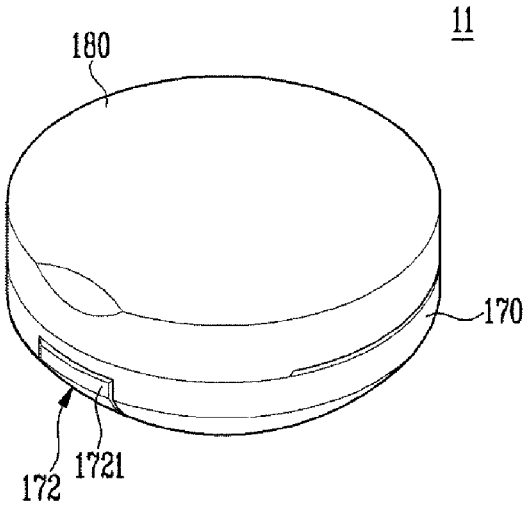
FIGS. 1 and 2 are perspective views of a cosmetic vessel according to a first to ninth embodiments of the present disclosure.

Objects, features and advantages of the present invention will become readily apparent by reference to the following detailed description when considered in conjunction with the accompanying drawings. As reference numerals are added to the objects in the drawings, the same objects although they are shown in the different drawings have same reference numeral as far as possible. Moreover, detailed descriptions related to well-known functions or configurations will be ruled out omitted in order not to unnecessarily obscure clearly describe the subject matters of the present invention.

Hereinafter, desirable embodiments of the present disclosure will be explained in detail with reference to the drawings attached.

Figure 2:
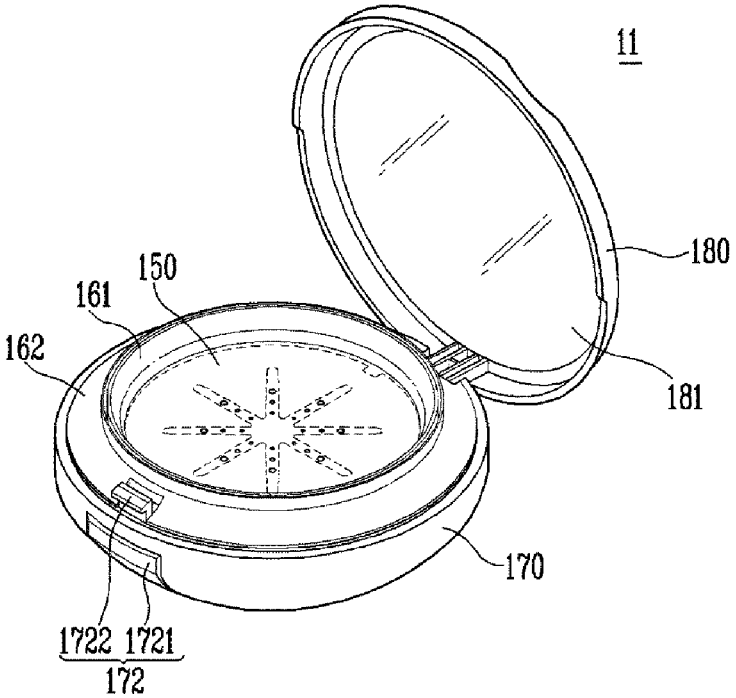

FIGS. 1 and 2 are perspective views of a cosmetic vessel according to a first to ninth embodiment of the present disclosure. FIG. 1 is a view illustrating a state where a lid 180 is closed, and FIG. 2 is a view illustrating a state where the lid 180 is open.

Figure 3:
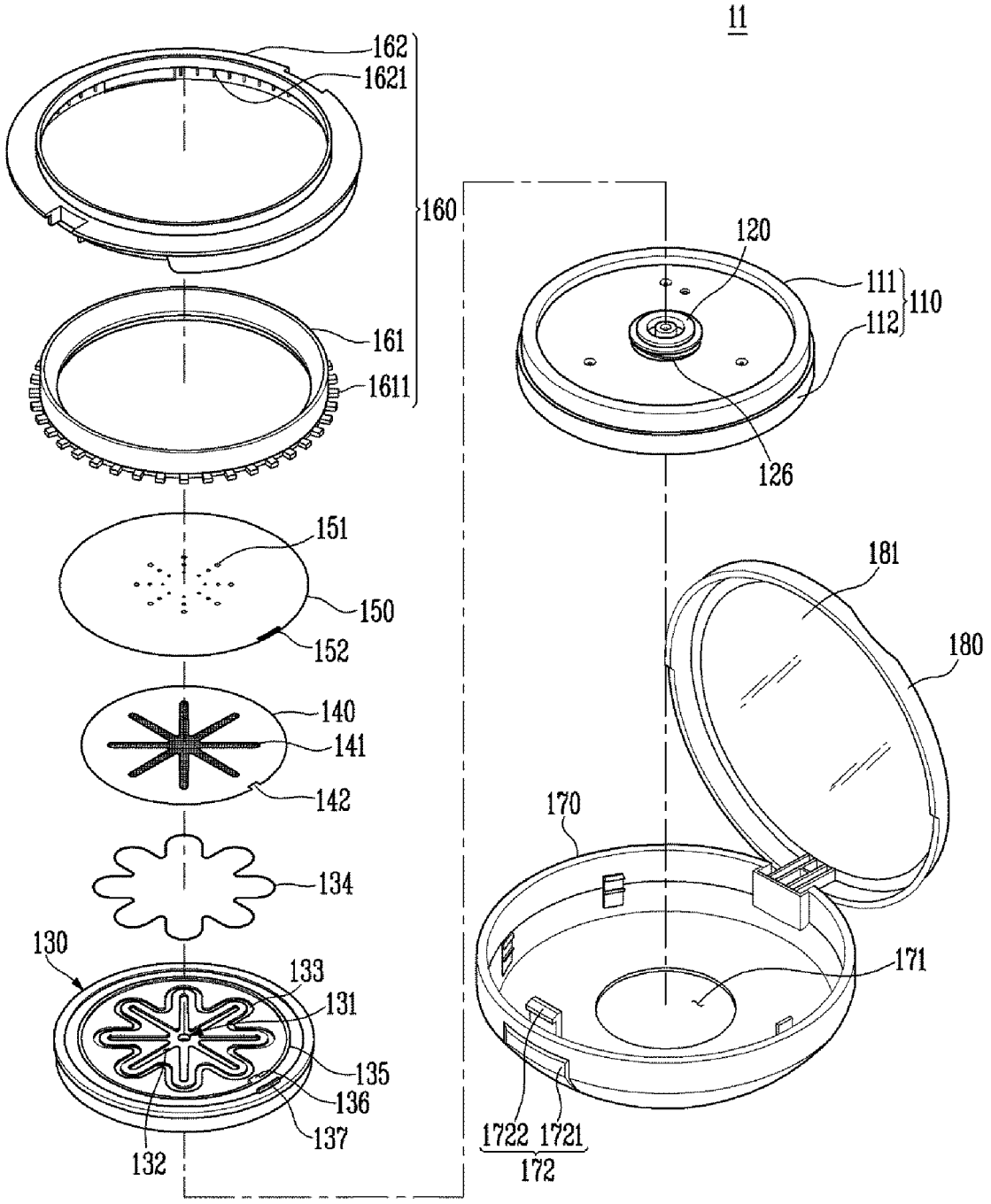
FIG. 3 is an exploded perspective view of a cosmetic vessel according to the first embodiment of the present disclosure.
Figure 4:
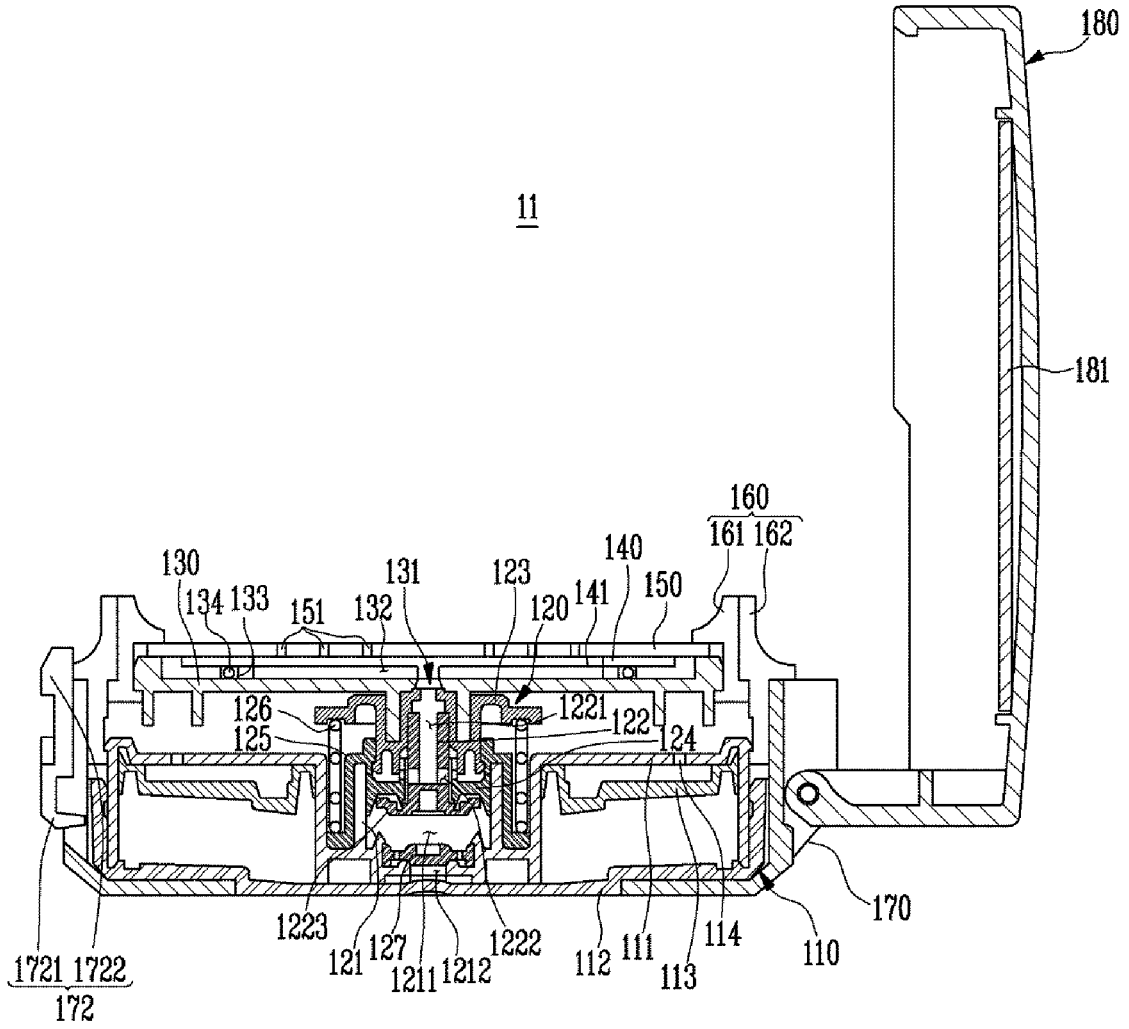
FIG. 4 is a cross-sectional view of a cosmetic vessel according to the first embodiment of the present disclosure.

In addition, FIG. 3 is an exploded cross-sectional view of a cosmetic vessel according to the first embodiment of the present disclosure, and FIG. 4 is a cross-sectional view of a cosmetic vessel according to the first embodiment of the present disclosure.

Referring to FIGS. 1 to 4, the cosmetic vessel 11 according to the first embodiment of the present disclosure includes a vessel body 110, a pump 120, guide plate 130, a mesh member 140, a discharge plate 150, a rim portion 160, an outer cover 170, and a lid 180.

The vessel body 110 receives cosmetics therein. The cosmetics stored in the vessel body 110 may be discharged outside by the pump 120 to be described below. Herein, the cosmetics may include liquid cosmetics.

The vessel body 110 may include a lower body 112 and an upper body 111. The vessel body 110 may be sealed by engaging the lower body 112 with the upper body 111. The vessel body 110 is divided into the upper and lower bodies so that the cosmetics may be easily received in the vessel body 110.

More specifically, the lower body 112 has an inwardly recessed portion. To store cosmetics in the vessel body 110, after the cosmetics is put into the lower body 112, the upper body 111 is engaged with the top portion of the lower body 112 to cover the lower body 112, so that it may be easy to fill the vessel body 110 with cosmetics.

However, the present embodiment is not limited to the vessel body 110 consisting of the lower body 112 and the upper body 111. Instead, a separate opening (not illustrated) for supplying cosmetics may be formed in the vessel body 110. Cosmetics may be received in the vessel body 110 through this opening, and the opening may then be sealed, so that the vessel body 110 may be filled with the cosmetics. In other words, the present embodiment does not particularly limit the shape and structure of the vessel body 110. Any type of vessel body may be used as long as a space for receiving cosmetics are defined in the vessel body.

The pump 120 may be provided in the vessel body 110. More specifically, the pump 120 may be located at the center of the upper part of the vessel body 110. Therefore, the cosmetics received in the vessel body 110 may be discharged in an upward direction of the vessel body 110 by the pump 120.

A press plate 113 may be formed in the vessel body 110. When the cosmetics received in the vessel body 110 are discharged by the pump 120, the volume of the vessel body 110 may be reduced, thereby decreasing the internal pressure. Herein, the press plate 113 may prevent the vessel body 110 from being damaged. In other words, since the press plate 13 descends as the cosmetics is discharged, a constant pressure may be maintained in the space where the cosmetics are stored. Herein, to allow the press plate 113 to descend, an air inlet 114 through which air may move into the vessel from the outside may be formed at the upper part of the cosmetic vessel.

The pump 120 which is provided in the vessel body 110 may discharge the cosmetics to the outside. The pump 120 may be an airless pump and suck liquid cosmetics received in the vessel body 110 to discharge the liquid cosmetics to the outside of the vessel body 110 in the upward direction of the vessel body 110. The discharged cosmetics may pass through the guide plate 130, the mesh member 140 and the discharge plate 150 and be exposed to the outside, where a user's puff may reach the discharged cosmetics.

The pump 120 may include a cylinder 121, a piston 122 and an elevating member 123. The cylinder 121 may have a hollow 1211 and be coupled to the central portion of the vessel body 110. The cylinder 121 may be formed integrally with the vessel body 110. The piston 122 and a piston ring 124 may be provided in the cylinder 121, and a first hole 1212 may be formed in a bottom portion of the cylinder 121 so that cosmetics may be introduced.

The piston 122 which is provided in the cylinder 121 performs an up-and-down motion to discharge the cosmetics in the vessel body 110 upwards and outwards. The hollow 1221 of the piston 122 allows the cosmetics to pass therethrough. A flange 1223 which protrudes outwards may be provided on a lower surface of the piston 122. In addition, a second hole 1222 may be formed in an outer circumferential surface of the piston 122 so that the cosmetics may be introduced.

The piston ring 124 may be provided on the outer circumferential surface of the piston 122 to seal the space between the piston 122 and the cylinder 121. The outside of the piston ring 124 may contact the cylinder 121, and the inside thereof may contact the piston 122 or the elevating member 123 to be described below. The piston ring 124 may perform an up-and-down motion by the piston 122 and the elevating member 123. However, an upward movement of the piston ring 124 may be realized by the flange 1223 and restricted by the elevating member 123, while a downward movement thereof may be realized by the elevating member 123 and restricted by the flange 1223.

The elevating member 123 is coupled to an upper part of the piston 122 and pressurizes the piston 122 when the elevating member 123 is moved downwards by an external force. The elevating member 123 may surround the upper part of the piston 122 and be coupled to the piston 122. In addition, the elevating member 123 may move upwards and downwards in conjunction with the piston 122. The piston ring 124 may be coupled to a lower part of the elevating member 123.

The piston ring 124 may be provided between the elevating member 123 and the cylinder 121. However, for further sealing, the pump 120 may include a sealing member 125. The sealing member 125 may surround the outside of the cylinder 121, cover a portion of the upper part of the cylinder 121, and closely contact a circumference of the lower part of the elevating member 123.

In addition, the pump 120 may further include an elastic member 126 to provide an upward elastic force to the elevating member 123 and the piston 122. The elastic member 126 may be a spring. An upper end of the elastic member 126 may closely contact a lower surface of the elevating member 123, and a lower end thereof may closely contact the cylinder 121 or an upper surface of the sealing member 125 to push up the elevating member 123.

Hereinafter, an operating principle of the pump 120 is described below. When the elevating member 123 moves downwards, the piston 122 also moves downwards. However, since the piston ring 124 does not move downwards due to friction with an inner surface of the cylinder 121, the second hole 1222 formed in the outer circumferential surface of the piston 122 moves away from the piston ring 124 and communicates with an internal space of the cylinder 121.

When the elevating member 123 continues to move downwards, the piston ring 124 is pressed by the elevating member 123 and moves downward to reduce a volume of the internal space of the cylinder 121 and increase a pressure of the internal space of the cylinder 121. Therefore, the cosmetics located in the internal space of the cylinder 121 with the increased pressure are discharged along the inside of the piston 122 through the second hole 1222 formed in the outer circumferential surface of the piston 122 which communicates with the internal space of the cylinder 121. To prevent backflow of the cosmetics, the pump 120 may further include a backflow preventing member 127 in the first hole 1212 formed in the lower part at the center of the cylinder 121.

On the other hand, when the elevating member 123 moves upwards by the elastic member 126, the piston ring 124 is stopped by friction with the inner surface of the cylinder 121 in the same manner as when the elevating member 123 moves downwards, and the piston ring 124 moves upwards by the flange 1223 of the piston 122.

When the piston ring 124 closely contacts the flange 1223 of the piston 122, the second hole 1222 in the outer circumferential surface of the piston 122 is closed. In addition, when the piston ring 124 moves upwards the volume of the internal space of the cylinder 121 is increased. Therefore, the internal space of the cylinder 121 has a low pressure. As a result, the cosmetics received in the vessel body 110 may be naturally introduced into the cylinder 121. By repeating the above processes, the pump 120 may allow the cosmetics received in the vessel body 110 to the outside.

However, the configuration of the pump 120 is not limited to the present embodiment, and other various methods may be used as the pump 120 in addition to the airless pump. In other words, any configuration of the pump 120 may be used as long as the cosmetics may be discharged from the vessel body 110.

In addition, according to the present embodiment, instead of using the pump 120 as a discharge portion, a sponge impregnated with liquid cosmetics may be used. As the sponge is pressed by the guide plate 130 to be described below, the cosmetics received in the sponge may be discharged to the outside through an outlet 131 of the guide plate 130.

The sponge may include at least one selected from the group consisting of polyamide, polyester, polyether, polyurethane, polyethylene, polystyrene, polyolefin, polyvinyl alcohol, polyamide, polypropylene, polyacryl, polyvinyl chloride, epoxy resin, sponge, nylon, cotton and non-woven fabric, etc.

The guide plate 130 may be coupled to an upper part of the pump 120 and guide the cosmetics discharged by the pump 120. The guide plate 130 may be provided between the pump 120 and the mesh member 140 to be described below and coupled to the elevating member 123 of the pump 120. When the guide plate 130 moves downwards, the elevating member 123 may also move downwards accordingly.

The guide plate 130 is described in detail with reference to FIG. 5.

Figure 5:
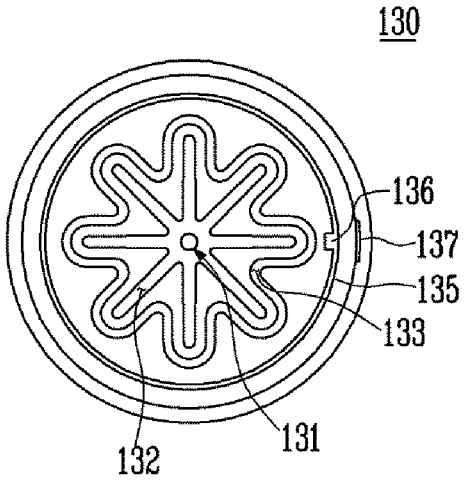
FIG. 5 is a plan view of a guide plate in a cosmetic vessel according to the first embodiment of the present disclosure.

FIG. 5 is a plan view of a guide plate of a cosmetic vessel according to the first embodiment of the present invention. Referring to FIG. 5, the outlet 131 may be formed in the guide plate 130 of the cosmetic vessel 11 according to the first embodiment of the present invention at a position corresponding to an outlet of the pump 120. The outlet of the pump 120 refers to the hollow 1221 of the piston 122. The outlet 131 may be located at the center of the guide plate 130.

In addition, the guide plate 130 may further include discharge paths 132 which communicate with the outlet 131 and are radially formed on the basis of the outlet 131. The cosmetics passes through the hollow 1221 in the piston 122 and is discharged through the outlet 131 of the guide plate 130. However, discharge holes 151 may not be formed in the discharge plate 150 at a position corresponding to the outlet 131. In other words, upward movements of the cosmetics discharged upwards through the outlet 131 of the guide plate 130 are blocked by the discharge plate 150.

The cosmetics flows radially along the discharge paths 132. Since the outlet 131 does not communicate with the outside, the discharge of the cosmetics may be prevented from being concentrated at the central part of the discharge plate 150 when the pump 120 operates.

The plurality of discharge paths 132 may be formed in a radial direction. In FIG. 5, eight discharge paths 132 are illustrated. However, the number of discharge paths 132 is not limited thereof. Since the discharge paths 132 has radial symmetrical, the cosmetics may be evenly discharged.

In addition, the guide plate 130 may further include an edge path 133 formed around the discharge paths 132. The cosmetics is discharged by the pump 120 and flows along the discharge paths 132. When the cosmetics more than the user needs are discharged, the cosmetics may leak along an outer surface of the guide plate 130 to contaminate the vessel body 110, and a user's hand holding the cosmetic vessel may be stained with the cosmetics to make the user feel unpleasant. Therefore, according to the present embodiment, since the edge path 133 is formed around the discharge paths 132, when the cosmetics flow over the discharge paths 132, the edge path 133 may prevent the cosmetics from being leaked to the outside.

The edge path 133 may be separated from the discharge paths 132 so as not to communicate with the discharge paths 132. Since the discharge paths 132 are formed in a radial direction, the edge path 133 may be in the shape of a flower or a circle which surrounds the radial discharge paths 132. In other words, when the edge path 133 is viewed from the top, the discharge paths 132 may protrude outwards at positions where the discharge paths 132 are formed and protrude inwards at positions where the discharge paths 132 are not formed.

A sealing member 134 may be mounted on the edge path 133. The sealing member 134 may be formed of a rubber or the like and have the same flower shape or circular shape as the edge path 133. Since the sealing member 134 is arranged on the edge path 133, even when the cosmetics reaches the edge path 133, the cosmetics may be blocked by the sealing member 134, so that cosmetics may not be discharged to the outside of the guide plate 130.

According to the present embodiment, the guide plate 130 may further include an auxiliary edge path having a circular shape (see 38 in FIG. 12), outside the edge path 133. A packing material having a circular shape (see 39 of FIG. 12) may be provided on the circular auxiliary edge path. The circular packing material may include a foam material, such as foam rubber or urethane foam, and prevent leakage of the cosmetics together with the sealing member 134. Therefore, according to the present embodiment, the cosmetics may be primarily sealed by the sealing member 134 provided on the edge path 133 and secondarily sealed by the packing material provided on the auxiliary edge path, the cosmetics discharged from the pump 120 may be completely prevented from being leaked to the outside by a double sealing structure.

However, the guide plate 130 of the present disclosure may form a diffusion space that replaces the discharge paths 132 or that is added to the discharge paths 132, a diffusion space allows the cosmetics to be discharged from the pump 120 and to be discharged to the discharge holes 151 of the discharge plate 150. Herein, the diffusion space may be a space having a disc shape, or one of a variety of shapes communicating with the discharge holes 151 such that the cosmetics discharged from the outlet of the pump 120 may be suitably distributed. Therefore, instead of having the discharge path 132, the guide plate 130 may have a diffusion space and be used as a diffusion portion.

The mesh member 140 may be provided at one side of the pump 120 where the cosmetics is discharged. At least a portion of the mesh member 140 may be formed in a mesh shape. The mesh member 140 may be provided at the upper part of the pump 120. More specifically, the mesh member 140 may be mounted on a top surface of a guide member. A guide rib 135 may be formed on the guide plate 130 to mount the mesh member 140 thereon. The mesh member 140 may be mounted in the guide rib 135 of the guide plate 130.

The mesh member 140 is described in detail with reference to FIG. 6.

Figure 6:
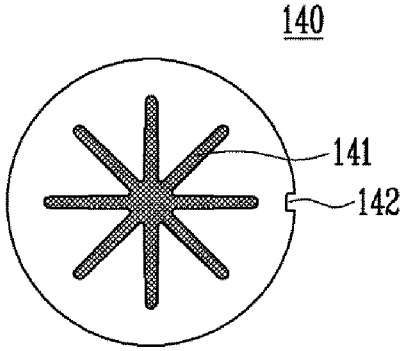
FIG. 6 is a plan view of a mesh member in a cosmetic vessel according to the first embodiment of the present disclosure.

FIG. 6 is a plan view of a mesh member of a cosmetic vessel according to the first embodiment of the present invention. As shown in FIG. 6, according to the first embodiment of the present invention, a groove 142 is formed at one side of the mesh member 140 of the cosmetic vessel 11, and a protrusion 136 is formed in the guide rib 135 of the guide plate 130, so that the mesh member 140 may be mounted in the guide rib 135 when the groove 142 is engaged with the protrusion 136. In other words, when the mesh member 140 is coupled to the guide member, an angle at which the mesh member 140 is mounted may be determined by the groove 142 and the protrusion 136. On the other hand, a protrusion may be formed on the mesh member 140, and a groove may be formed in the guide plate 130, whereby the angle at which the mesh member 140 is mounted may be determined.

The angle at which the mesh member 140 is mounted refers to a predetermined angle at which the mesh member 140 is mounted onto the guide plate 130, among angles at which the mesh member 140 rotates on the basis of a line which passes through the center of the mesh member 140 in a vertical direction.

The angle at which the mesh member 140 is mounted is determined so that the radially formed discharge paths 132 of the guide plate 130 and the mesh portion 141 of the mesh member 140 may match with each other. When the mesh portion 141 of the mesh member 140 has a circular shape covering the discharge paths 132, it may not be necessary to determine the angle at which the mesh member 140 is mounted. However, since the mesh portion 141 of the mesh member 140 has a circular shape, when the mesh portion 141 tightly contacts the edge path 133, the cosmetics may be transferred via the mesh portion 141 to the edge path 133 from the discharge paths 132. As a result, a sealing effect may be deteriorated.

Therefore, the mesh portion 141 may have a shape and size to cover all the discharge paths 132 and not to correspond to the edge path 133. In other words, more specifically, when the edge path 133 has a flower shape, the mesh portion 141 may have a radial shape. The angle at which the mesh member 140 is mounted may be determined by the groove 142 and the protrusion 136. When the edge path 133 has a circular shape, the mesh portion 141 may have a circular shape, and it may not be necessary to determine the angle at which the mesh member 140 is mounted. However, although the edge path 133 has a circular shape, if the mesh portion 141 has a radial shape, the mesh portion 141 may necessarily correspond to a discharge path, the angle at which the mesh member 140 is mounted may be necessarily determined. However, since a plurality of angles at which the mesh member 140 is mounted may be determined by the number of discharge paths 132, there may be provided a plurality of grooves 142 and a plurality of protrusions 136.

As described above, since the mesh portion 141 is formed in the mesh member 140, the liquid cosmetics discharged through the guide plate 130 may pass through the mesh portion 141, so that the mesh member 140 may prevent splashing of cosmetics. In other words, since the mesh portion 141 of the mesh member 140 may slightly block movements of the cosmetics, even when the user operates the pump 120 to discharge the cosmetics to the outside, the cosmetics may gently flow along the discharge holes 151 of the discharge plate 150 without splashing. The mesh portion 141 of the mesh member 140 may include fiber such as polyester, nylon, wool, and cotton, or mixed yarns, or various materials such as iron, zinc, copper, an alloy thereof, plated metals, etc. Also, the mesh portion 141 may be appropriately formed in consideration of elements and viscosity of the contents, purpose and product safety.

Therefore, according to the present embodiment, when the cosmetics is discharged by the pump 120, since the mesh portion 141 of the mesh member 140 interrupts discharge of the cosmetics, the cosmetics discharged to the outside may be evenly supplied to the discharge plate 150 without splashing. Accordingly, according to the present embodiment, a space used thereby may not be contaminated, and user convenience may be improved.

However, the mesh member 140 may be omitted depending on the viscosity of the cosmetics. That is, when the cosmetics has a high viscosity, it is not expected that the cosmetics will splash, and thus it is possible to omit the mesh member 140, and have the cosmetics be discharged outside through the guide plate 130 and discharge plate 150. In such a case, the guide plate 130 may serve as a diffusion portion configured to diffuse the cosmetics so that the cosmetics may be discharged to the discharge hole 151 of the discharge plate 150 as aforementioned.

The discharge plate 150 may be provided at the top surface of the mesh member 140 and include the plurality of discharge holes 151. The discharge plate 150 may include a metallic material such as anti-rust iron, stainless steel, copper, zinc, tin, and aluminum, an alloy thereof, plated metals, etc. When the discharge plate 150 is plated with anti-corrosive, anti-fouling, and antimicrobial metals, for example, chromium, copper, silver, or gold, beauty and elegance are added so that users may feel that the discharge plate 150 is sophisticated. At the same time, the discharge plate 150 may be plated with materials which satisfy hygiene requirements. The discharge holes 151 may be provided at a position corresponding to the mesh portion 141 of the mesh member 140 or the discharge paths 132 of the guide plate 130.

The discharge plate 150 may have a thickness of 0.1 to 1 mm (preferably, 0.2 mm to 0.3 mm) and include metal having excellent corrosion resistance and rust resistance, such as aluminum, aluminum alloy, stainless steel, etc., or the discharge plate 150 may include ceramics or the like.

More specifically, the discharge plate 150 may include SUS 304 among SUS 300 series having good corrosion resistance, acid resistance and heat resistance. More particularly, to improve antimicrobial resistance and hygienic conditions, the discharge plate 150 may include 304J1 material.

However, according to the present embodiment, the material of the discharge plate 150 is not limited thereto. The discharge plate 150 may include at least one of 301L, 304L, 304LN, 304N1, 305EG, 309S, 310S, 316, 316L, 316LN, 316Ti, 317L, 321, 347, 329J3L, and 329LD including 304 series.

Therefore, according to the present embodiment, by using the discharge plate 150 made of a SUS 300 series stainless steel, the top surface of the discharge plate 150 on which the cosmetics discharged by the pump 120 are placed and remain may be kept clean, and corrosion may be effectively prevented.

In addition, according to the present embodiment, by using the metallic discharge plate 150, the discharge plate 150 may efficiently dissipate heat, so that a cooling effect may be obtained to reduce the temperature of the cosmetics.

According to the present embodiment, as described above, an impregnated sponge may replace the pump 120. When the impregnated sponge is used, the metallic discharge plate 150 may be used to pressurize the impregnated sponge.

However, when the discharge plate 150 directly presses the impregnated sponge, as the impregnated sponge keeps contacting the discharge plate 150, the temperature of the discharge plate 150 is in equilibrium with the temperature of the impregnated sponge. As a result, when the cosmetics are discharged from the impregnated sponge, the discharge plate 150 may not cool down the cosmetics. In addition, air may be introduced into the impregnated sponge through the discharge holes 151 of the discharge plate 150 to contaminate the cosmetics received in the impregnated sponge.

However, according to the present embodiment, even when the impregnated sponge is used, since the guide plate 130 and the mesh member 140 are disposed between the discharge plate 150 and the impregnated sponge, the discharge plate 150 may be separated from a discharge portion, such as the impregnated sponge to avoid contamination of cosmetics as described above.

Accordingly, according to the present embodiment, since the discharge plate 150 is separated from the discharge portion for discharging the cosmetics, the discharge plate 150 may maintain a lower temperature than the cosmetics, so that the cosmetics discharged through the discharge portion may cool down when contacting the discharge plate 150, which may make the user feel extremely satisfied.

In addition, according to the present embodiment, since the airless pump 120 may be used as a discharge unit, even when air is introduced through the discharge holes 151 formed in the discharge plate 150, the airless pump 120 may prevent air from being transmitted to the cosmetics received in the pump 120 to thereby protect the cosmetics against contamination. In addition, according to the present embodiment, when the pump 120 is used, the remaining usage amount may be reduced to approximately 5% as compared when an impregnated sponge is used.

The cosmetics remains on the top surface of the discharge plate 150. When the user rubs the cosmetics remaining on the top surface of the discharge plate 150 with a puff or the like, the top surface of the discharge plate 150 may wear down due to powder contained in the cosmetics. Therefore, according to the present embodiment, by coating the top surface of the discharge plate 150 or plating it with a predetermined material, even when the user rubs the top surface of the discharge plate 150 to pick up the cosmetics, deterioration in durability of the discharge plate 150 may be prevented.

The discharge plate 150 may be plated with a different metal from the metal forming the discharge plate 150. For example, the discharge plate 150 may be plated with chromium. More specifically, the discharge plate 150 may be plated with trivalent chromium or hexavalent chromium.

As described above, according to the present embodiment, since the discharge plate 150 is formed of a metal material and at least one surface thereof is plated with chromium, hygiene, anti-microbial resistance and durability may be ensured. In addition, the cosmetics remaining on the discharge plate 150 may be easily cleaned to keep the discharge plate 150 clean and increase user convenience. In other words, according to the present embodiment, since a separate member is not placed on the top surface of the discharge plate 150, the top surface of the discharge plate 150 may be directly exposed to the outside.

The discharge paths 132 of the guide plate 130 are radially formed, and the mesh portion 141 of the mesh member 140 covers the discharge paths 132 of the guide plate 130. Thus, the discharge holes 151 may be radially formed in substantially the same manner as the discharge paths 132.

The radially formed discharge holes 151 may increase in diameter as the discharge holes 151 are away from the center of the discharge plate 150. The cosmetics are discharged from the center by the pump 120 and flow along the discharge paths 132 of the guide plate 130. Therefore, a rate of flow of the cosmetic may gradually decrease from the center. Therefore, when the discharge holes 151 have the same diameter, the cosmetics may not be unevenly spread over the top surface of the discharge plate 150. Thus, the discharge holes 151 may increase in diameter as the discharge holes 151 are away from the center.

As described above, the discharge holes 151 may not be formed in the central portion of the discharge plate 150. When the discharge holes 151 are formed at the central portion of the discharge plate 150, if the guide plate 130 is strongly pressed, the cosmetics may pass through the outlet 131 of the guide plate 130, the mesh portion 141 of the mesh member 140, and the discharge holes 151 of the discharge plate 150 at the same time and therefore splash up.

The discharge holes 151 formed in the discharge plate 150 may have a very small diameter ranging from 0.1 to 1 mm. When the discharge holes 151 have a smaller diameter, the user may precisely control the amount of cosmetics discharged to the upper part of the discharge plate 150 by the pump 120, and foreign matters may not be introduced therein through the discharge holes 151.

More specifically, the discharge holes 151 may be radially provided and separated from each other at 45 degree intervals on the basis of the center of the discharge plate 150. Three discharge holes 151 may be arranged next to each other in a predetermined direction away from the center of the discharge plate 150. These three discharge holes 151 arranged next to each other may sequentially have diameters of 0.3 mm, 0.4 mm, and 0.5 mm from the center of the discharge plate 150 towards the outside.

Therefore, according to the present embodiment, since the discharge plate 150 including the discharge holes 151 having the above-described very small diameters are used for the airless pump 120, the cosmetics may be prevented from contacting air, so that some of the materials included in the cosmetics may be sufficiently prevented from being volatilized.

As described above, since the discharge holes 151 have very small diameters, when the discharge plate 150 is manufactured by injection molding, it may be difficult to accurately manufacture the discharge holes 151. Therefore, according to the present embodiment, after the discharge plate 150 is manufactured, the discharge holes 151 may be formed by etching, so that the discharge holes 151 having a diameter of 0.1 mm may be manufactured.

A protrusion 137 may be formed at one side of the guide plate 130, and a coupling hole 152 may be formed in the discharge plate 150 so that the discharge holes 151 of the discharge plate 150 may correspond to the radially formed discharge paths 132 of the guide plate 130. The protrusion 137 is engaged with the coupling hole 152. In other words, the discharge plate 150 may be mounted on the guide plate 130 by engaging the protrusion 137 of the guide plate 130 with the coupling hole 152. In this manner, as described above in connection with the mesh member 140, an angle at which the discharge plate 150 is mounted may be determined. However, a detailed description thereof will be omitted since it is given earlier in connection with the groove 142 and the protrusion 136.

The rim portion 160 may be coupled to the upper part of the guide plate 130 and the vessel body 110. The rim portion 160 may include an inner rim portion 161 and an outer rim portion 162. The inner rim portion 161 may surround the edge of the discharge plate 150 and be coupled to the guide plate 130 to fix the guide plate 130, the mesh member 140, and the discharge plate 150 while being compressed. The inside of the inner rim portion 161 may be penetrated to expose the discharge plate 150 to the outside, so that the cosmetics discharged to the top surface of the discharge plate 150 may be exposed to the outside.

The inner rim portion 161 may be formed integrally with the discharge plate 150 since when the inner rim portion 161 moves downwards, the discharge plate 150 also moves downwards. In this example, the material of the inner rim portion 161 may be similar to or the same as that of the discharge plate 150. For example, the inner rim portion 161 may include iron, stainless steel, copper, zinc, tin, aluminum, an alloy thereof, plated metals, etc. In addition, in a similar manner as the discharge plate 150, the inner rim portion 161 may include chromium, copper, silver, gold, etc. in order to achieve beauty and durability.

The outer rim portion 162 may be provided on the outside of the inner rim portion 161 and coupled with the vessel body 110. However, the outer rim portion 162 may not be fixed to the inner rim portion 161, allow elevating or lowering of the inner rim portion 161, and surround the outside of the inner rim portion 161. To this end, inner teeth 1611 may be formed on an outer surface of the inner rim portion 161, and outer teeth 1621 having a shape corresponding to the inner teeth 1611 of the outer rim portion 162 may be formed on an inner surface of the outer rim portion 162, so that the outer rim portion 162 may restrict the rotation of the inner rim portion 161 and allow the elevating and lowering thereof.

A portion engaged with a hinge structure of a lid 180 to be described below and a portion corresponding to a latching portion 172 may be recessed into a side surface of the outer rim portion 162 to avoid interference between components.

The outer rim portion 162 may be coupled to an outer cover 170 to be described below. The inner rim portion 161 may be raised or lowered on the basis of the outer rim portion 162 to operate the pump 120. In other words, when the user grips the outer cover 170 and presses the discharge plate 150 in the inner rim portion 161 with a puff (not illustrated) or etc, the inner rim portion 161 coupled to the discharge plate 150 in the outer rim portion 162 coupled to the outer cover 170 moves downwards, and the guide plate 130 also moves downwards to cause the pump 120 to operate, so that the cosmetics may be provided on the top surface of the discharge plate 150 and the inside of the inner rim portion 161. Therefore, the user may apply the cosmetics by picking up the cosmetics exposed on the top surface of the discharge plate 150 with the puff or the like.

The outer cover 170 is configured to surround the vessel body 110. The outer cover 170 has a space in which the vessel body 110 is mounted. However, an opening 171 may be formed in a lower part of the outer cover 170 to expose the vessel body 110. The user pushes up the vessel body 110 through the opening 171 of the outer cover 170 to separate vessel body 110 therefrom, so that the vessel body 110 may be replaced with a new one.

The top surface of the outer cover 170 may be covered by the outer rim portion 162, the inner rim portion 161 and the discharge plate 150 in a sequential manner from the outside to the center. Thus, from the outside, the user cannot see the guide plate 130, the mesh member 140, and the pump 120. Therefore, according to the present embodiment, the beauty of the cosmetic vessel may be improved to increase user satisfaction.

The outer cover 170 may include the latching portion 172. The latching portion 172 may be coupled to the lid 180 to prevent the lid 180 from opening. The latching portion 172 may include a button 1721 and a latch 1722 formed in a single body. In other words, when the user pushes the button 1721, the latch 1722 also moves in a direction in which the button 1721 is pressed. In this manner, the latching portion 172 may control opening and closing of the lid 180 by separating the latch 1722 from the lid 180.

The lid 180 opens and closes one side of the outer cover 170 (herein, upper side). One side of the lid 180 may be coupled to the outer cover 170 using a hinge. The lid 180 may rotate on the basis of the center of the hinge to open the upper side of the outer cover 170. The lid 180 may be fixed while sealing the upper side of the outer cover 170 by the latching portion 172.

The lid 180 may be coupled to the outer cover 170 using the hinge. A spring may be provided on the hinge structure so that the lid 180 may be automatically opened when the lid 180 is released from the latching portion 172.

A mirror 181 may be provided on the inside of the lid 180. While the user looks into the mirror 181 after opening the lid 180, the user may discharge the cosmetics from the vessel body 110 by pressurizing the discharge plate 150 or the inner rim portion 161.

As described above, according to the present embodiment, when the cosmetics are discharged from the pump 120, the movements of the cosmetics are blocked by the mesh member 140 to prevent the cosmetics from spurting from the top surface of the discharge plate 150, so that the user may use the cosmetics with convenience and cleanliness.

Figure 7:
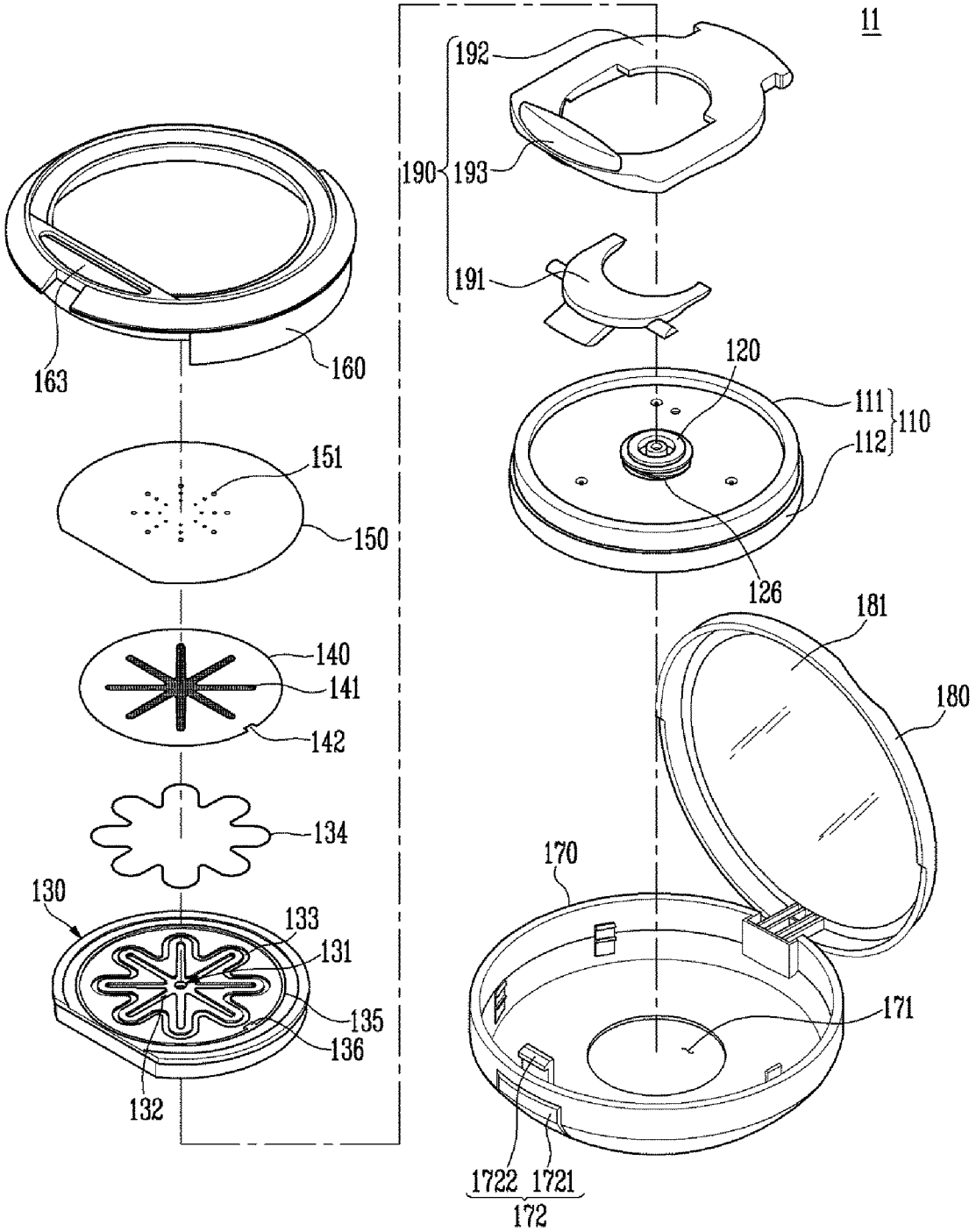
FIG. 7 is an exploded perspective view of a cosmetic vessel according to the second embodiment of the present disclosure.
Figure 8:
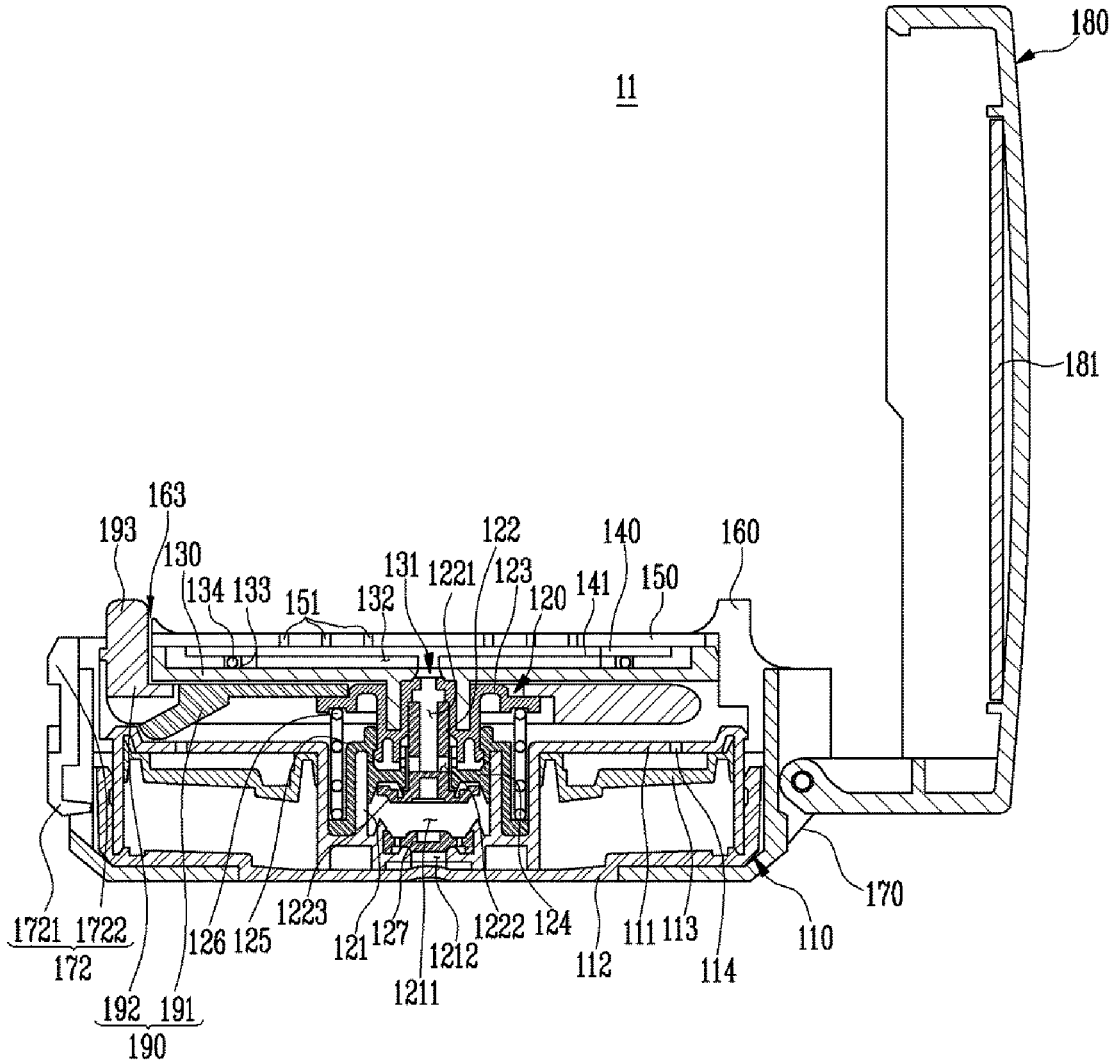
FIG. 8 is a cross-sectional view of a cosmetic vessel according to the second embodiment of the present disclosure.

FIG. 7 is an exploded perspective view of a cosmetic vessel according to the second embodiment of the present invention. FIG. 8 is a cross-sectional view of a cosmetic vessel according to the second embodiment of the present invention.

Referring to FIGS. 7 and 8, according to the second embodiment of the present invention, the cosmetic vessel 11 may further include a button portion 90.

Hereinafter, the differences between the present embodiment and the first embodiment will be described in detail. Although the configuration of the present embodiment is denoted by the same reference numerals as those of the first embodiment, it does not necessarily mean that both embodiments have the same configuration.

The guide plate 130 may have a disc shape with a cut-off portion at one side thereof to ensure a space in which the button portion 190 to be described below is located. In this case, the protrusion described above according to the first embodiment may be removed. However, the outlet 131 and the discharge paths 132 formed on the upper part of the guide plate 130 may be the same as those of the first embodiment.

The discharge plate 150 may have a disc shape with a cut-off portion at one side like the guide plate 130, and the coupling hole 152 is omitted. However, since each of the guide plate 130 and the discharge plate 150 has a disc shape with a cut-off portion at one side thereof, it may be possible to smoothly align the guide plate 130 and the discharge plate 150 without providing the protrusion or the coupling hole included in the first embodiment.

The rim portion 160 may be coupled to the upper part of the guide plate 130 and the vessel body 110. According to the present embodiment, since the pump 120 may be operated using the button portion 190, the rim portion 160 may be formed as a single body unlike the rim portion 160 according to the first embodiment. In addition, since the rim portion 160 may be firmly fixed to the vessel body 110, it may be impossible to raise or lower the rim portion 160.

A through hole 163 may be formed in the rim portion 160 so that one side of the button portion 190 to be described below may be exposed to the outside. Since the button portion 190 causes the pump 120 to operate when the protruding portion 193 is pressed by the user, the protruding portion 193 may be exposed to the outside for the user to press. A description thereof will be given below. Therefore, the rim portion 160 includes the through hole 163 so that the user may easily access the button portion 190.

The button portion 190 is provided above the pump 120 and causes the pump 120 to operate. When a portion exposed through the through hole 163 of the rim portion 160 is pressed by the user, the button portion 190 causes the elevating member 123 of the pump 120 to move downwards so that the cosmetics received in the pump 120 may be discharged to the outside. The button portion 190 may include an auxiliary button 191 and a primary button 192.

One end of the auxiliary button 191 is mounted on a top surface of the elevating member 123, and the other end thereof may be inclined downwards so that the auxiliary button 191 may be mounted on the vessel body 110 (specifically, upper body 111) to provide an elastic force to the primary button 192 to be described below.

The primary button 192 may be mounted on an upper part of the auxiliary button 191, a protruding portion 193 is formed at one end thereof, and a portion thereof may be mounted on the top surface of the elevating member 123. A portion of the top surface of the elevating member 123 on which one end of the auxiliary button 191 is mounted and another portion thereof on which the portion of the primary button 192 is mounted may be located opposite to each other. Thus, when the elevating member 123 moves downwards by the primary button 192 and the auxiliary button 191, the elevating member 123 may stably move downwards without being tilted.

The protruding portion 193 of the primary button 192 may be exposed through the through hole 163 of the rim portion 160 for the user to press. When the user presses the protruding portion 193, a portion of the primary button 192 corresponding to the top surface of the elevating member 123 moves downwards, and a portion of the auxiliary button 191, pressed by the primary button 192, corresponding to the top surface of the elevating member 123 may move downwards. Therefore, as the elevating member 123 moves downwards by the primary button 192 and the auxiliary button 191, the cosmetics may be discharged to the discharge plate 150.

According to the present embodiment, instead of the button portion 190, a button portion (not illustrated) which extends from the side of the vessel body 110 causes the pump 120 to operate when being pressed by the user. In addition, according to the present embodiment, various structures may be used to operate the pump 120. For example, the pump 120 may be operated by rotation of a screw.

As described above, unlike first embodiment, according to the present embodiment, the rim portion 160 does not move downwards, and the cosmetics is discharged to the discharge plate 150 by using the button portion 190. Therefore, abnormal discharge caused by the discharge holes 151 clogged by the puff when the user presses the discharge plate 150 with the puff to discharge the cosmetics according to the first embodiment may be avoided, and the discharge of the cosmetics may become easier, thereby increasing user satisfaction.

Figure 9:
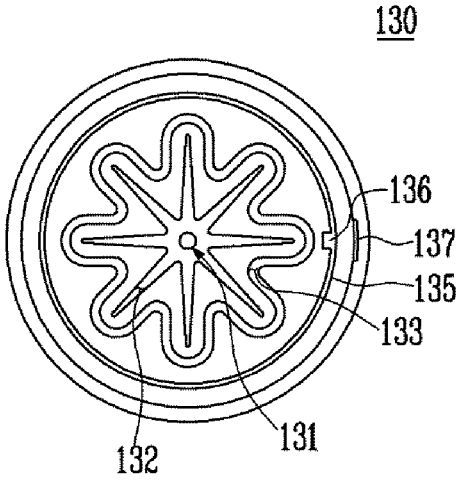
FIG. 9 is a plan view of a guide plate of a cosmetic vessel according to the third embodiment of the present disclosure.
Figure 10:
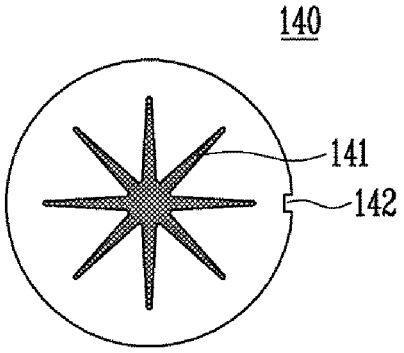
FIG. 10 is a plan view of a mesh member of a cosmetic vessel according to the third embodiment of the present disclosure.

FIG. 9 is a plan view of a guide plate of a cosmetic vessel according to a third embodiment of the present invention. FIG. 10 is a plan view of a mesh member of a cosmetic vessel according to a third embodiment of the present invention.

Referring to FIGS. 9 and 10, according to the third embodiment of the present invention, the discharge paths 132 of the guide plate 130 and the mesh portion 141 of the mesh member 140 of the cosmetic vessel may be different from those of the earlier described embodiments. Hereinafter, the differences between the present embodiment and the first and embodiments will be described in detail. Although the configuration of the present embodiment is denoted by the same reference numerals as those of the first and second embodiments, it does not necessarily mean that these embodiments have the same configuration.

The guide plate 130 is coupled to the upper part of the pump 120 to guide the cosmetics discharged by the pump 120. As described above with reference to the first embodiment, the guide plate 130 may include the outlet 131, the discharge paths 132 and the edge path 133. The discharge paths 132 are reduced or increased as the discharge paths 132 are away from the outlet 131 located at the center of the guide plate 130.

When the cosmetics is discharged from the pump 120, the cosmetics pass through the outlet 131, move along the discharge paths 132, and are exposed to the outside through the discharge holes 151 of the discharge plate 150. In order that the cosmetics may be discharged through the discharge holes 151 which are distant from the discharge plate 150, the cosmetics is to be sufficiently filled from the outlet 131 to one location of the discharge paths 132 (at which the discharge paths 132 communicate with the discharge holes 151 distant from the center). Therefore, the amount of the cosmetics being discharged through the discharge holes 151 which are distant from the center may be not enough.

Therefore, according to the present embodiment, the discharge paths 132 are reduced as the discharge paths 132 are away from the outlet 131, so that the remaining amount of the cosmetics on the discharge paths 132 may be reduced, and a sufficient amount of cosmetics may be discharged although the discharge holes 151 of the discharge plate 150 are distant from the center of the discharge plate 150.

The mesh member 140 is provided at one side of the pump 120 where the cosmetics is discharged. At least portion of the mesh member 140 may have a mesh shape. In other words, since the cosmetics move from the mesh member 140 through the mesh portion 141 and are discharged to the outside, according to the present embodiment, splashing of the cosmetics discharged from the pump 120 may be prevented when low viscosity cosmetics are used.

The mesh portion 141 may have a shape corresponding to the discharge paths 132. In other words, the mesh portion 141 may be radially formed so as to correspond to the discharge paths and be gradually reduced or expanded (preferably reduced) away from the center. Therefore, the mesh portion 141 may sufficiently cover the discharge paths 132 to prevent splashing of the lower viscosity cosmetics.

As described above, according to the present embodiment, the discharge paths 132 of the guide plate 130 are gradually reduced away from the outlet 131, so that a sufficient amount of the cosmetics may be discharged through all discharge holes 151 formed in the discharge plate 150. As a result, user satisfaction may be increased.

Figure 11:
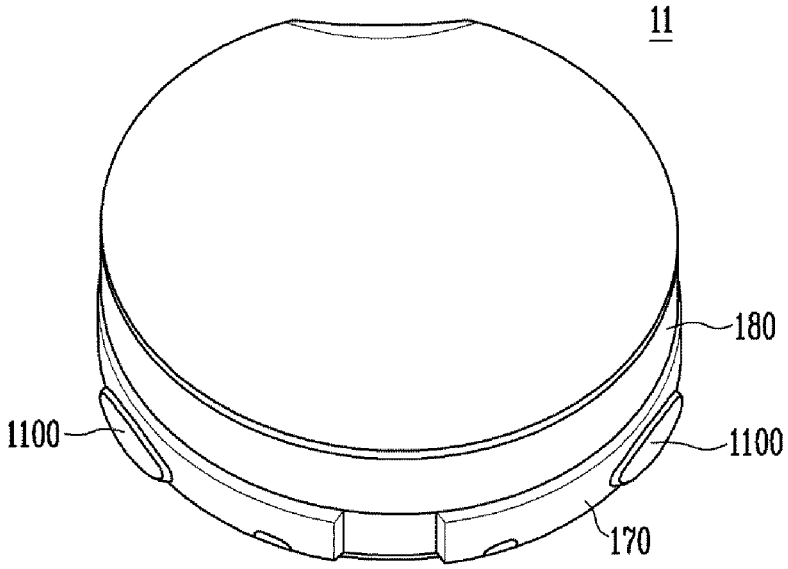
FIG. 11 is a perspective view of a cosmetic vessel according to the fourth embodiment of the present disclosure.
Figure 12:
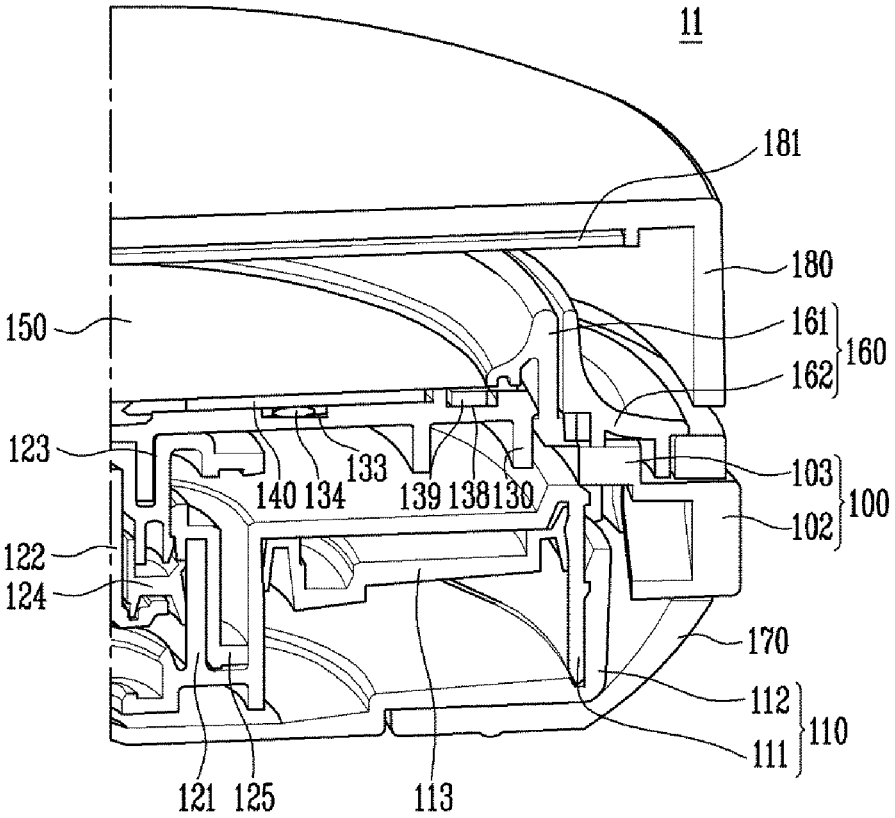
FIG. 12 is a cross-sectional view of a cosmetic vessel according to the fourth embodiment of the present disclosure.
Figure 13:
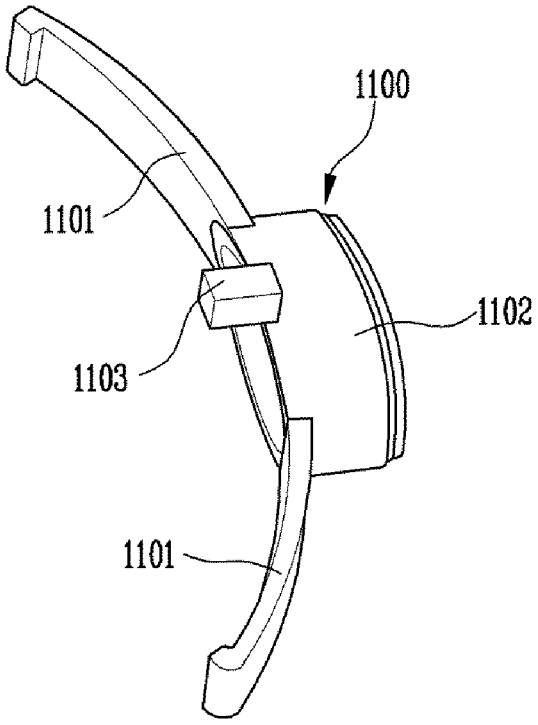
FIG. 13 is a perspective view of a locking portion of a cosmetic vessel according to the fourth embodiment of the present disclosure.

FIG. 11 is a perspective view of a cosmetic vessel according to the fourth embodiment of the present invention. FIG. 12 is a cross-sectional view of a cosmetic vessel according to the fourth embodiment of the present invention. FIG. 13 is a perspective view of a locking portion of a cosmetic vessel according to the fourth embodiment of the present invention.

Referring to FIGS. 11 to 13, according to the fourth embodiment of the present invention, the cosmetic vessel 11 may include a locking portion 1100. The differences between the present embodiment and the first to third embodiments will be described in detail. Although the configuration of the present embodiment is denoted by the same reference numerals as those of the first to third embodiments, it does not necessarily mean that these embodiments have the same configuration.

The locking portion 1100 may control the discharge of the cosmetics by the pump 120. A portion of the locking portion 1100 may protrude from an outer surface of the outer cover 170 and be pressed by the user if necessary to thereby control the operations of the pump 120.

The locking portion 1100 may be included to avoid inadvertent discharge of cosmetics caused by pressing the discharge plate 150 when the user rubs the cosmetics to evenly spread on the discharge plate 150 using the puff after the user presses the discharge plate 150 to discharge the cosmetics to the top surface of the discharge plate 150 from the pump 120.

Therefore, according to the present embodiment, by providing the locking portion 1100, since the user is able to control the discharge of the cosmetics by pressing the locking portion 1100 after a desirable amount of the cosmetics is discharged to the top surface of the discharge plate 150, the user may conveniently apply the cosmetics discharged to the discharge plate 150 with the puff.

To this end, at least one locking portion 1100 may be formed at the outer cover 170 that the user grips, and any locking portion 1100 may control the discharge of the pump 120. For example, the locking portions 1100 may be provided at the left and right of the portion at which the outer cover 170 and the lid 180 are engaged with each other by a hinge.

The locking portion 1100 includes an elastic piece 1101, a protruding portion 1102 and a locking protrusion 1103. The elastic piece 1101 may extend a predetermined length from one side (preferably both sides) of the locking portion 1100 and have an elastic force. The elastic force of the elastic piece 1101 may be exerted on the protruding portion 1102 to cause the protruding portion 1102 to protrude to the outside of the vessel body 110 when an external force is not applied.

One end of the elastic piece 1101 may be connected to the protruding portion 1102 to be described below, and the other end thereof may tightly contact to the outside of the vessel body 110. When the protruding portion 1102 is pushed in by the user, the other end of the elastic piece 1101 slides along the outer surface of the vessel body 110 to allow the protruding portion 1102 to be inserted therein.

The protruding portion 1102 may be exposed to the outside of the outer cover 170 and pressed by the user. To this end, a through hole (not illustrated) corresponding to the shape of the protruding portion 1102 may be formed in the outer cover 170.

The protruding portion 1102 may have a curved shape so that the user may conveniently press the protruding portion 1102 and the cosmetic vessel may look better. In addition, since a friction surface is formed, user convenience may be increased.

An elastic force may be applied to the protruding portion 1102 from elastic piece 1101 in an outward direction on the basis of the center of the pump 120. The protruding portion 1102 moves towards the center of the pump 120 when being pressed by the user. The locking portion 1100 may provide locking as the locking protrusion 1103 moves in conjunction with the protruding portion 1102.

The locking protrusion 1103 is provided on the protruding portion 1102 and prevents the discharge plate 150 from moving downwards. More specifically, when the protruding portion 1102 is pressed by the user, the locking protrusion 1103 may move inwards from the outside on the basis of the pump 120 to prevent the discharge plate 150 from moving downwards.

A top surface of the locking protrusion 1103 tightly contacts a lower part of the inner rim portion 161 of the rim portion 160 which may move downwards to prevent the inner rim portion 161 from moving downwards and thus prevent the discharge plate 150 from moving downwards, so that the discharge of the cosmetics of the pump 120 may be controlled.

According to the present embodiment, the button portion 190 according to the second embodiment may be used herein. The locking portion 1100 may prevent the button portion 190 from moving downwards so as not to cause the pump 120 to operate. Since the protruding portion 1102 is inserted, the locking protrusion 1103 of the locking portion 1100 may tightly contact a bottom surface of the button portion 190 to prevent the operations of the button portion 190.

As described above, according to the present embodiment, since the user easily controls the operations of the pump 120 by using the locking portion 1100 after the cosmetics is discharged to the discharge plate 150, the cosmetics may not be discharged even when the user taps the cosmetics discharged to the discharge plate 150 to evenly spread the cosmetics, so that waste of the cosmetics may be avoided to significantly increase user satisfaction.

Hereinafter, based on the specific experimental data, a cooling effect of the cosmetic vessel 11 according to the present invention is proved and described.

Figure 14:
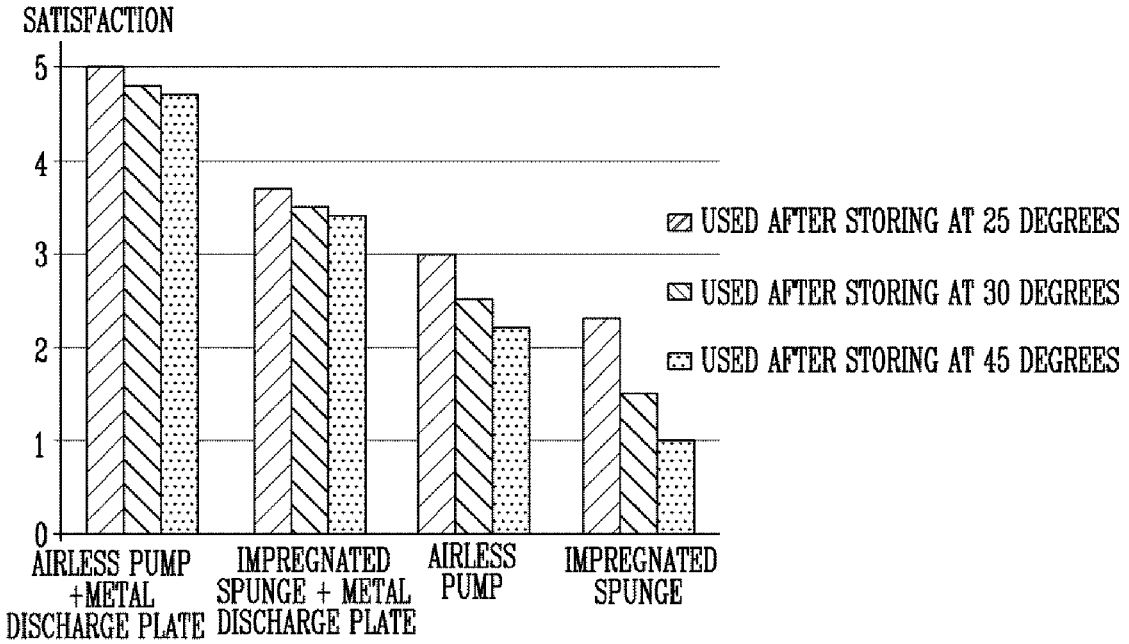
FIG. 14 is a graph showing user satisfaction with a cooling effect of a cosmetic vessel according to the present disclosure.
Figure 15:
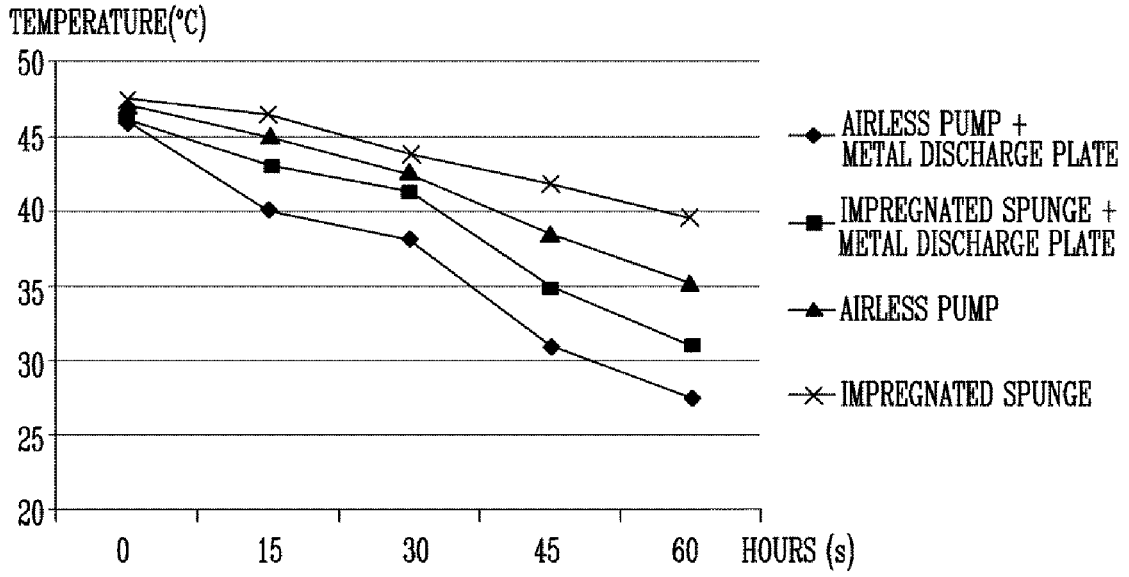
FIG. 15 is a graph showing temperature changes of a cosmetic vessel according to the present disclosure.

FIG. 14 is a graph showing user satisfaction with a cooling effect of a cosmetic vessel according to the present invention. FIG. 15 is a graph showing a temperature change of a cosmetic vessel according to the present invention.

Table 1 below shows user satisfaction when a user used the cosmetic vessels 11 and the conventional cosmetic vessels which were left for one minute at predetermined temperatures. More specifically, fifty users were surveyed and gave grades on a scale of zero to five, and average values were calculated. FIG. 14 is a graph of the values shown in Table 1.

TABLE 1

| | Airless pump + metallic discharge plate | Impregnated sponge + metallic discharge plate | Airless pump | Impregnated sponge |
|---|---|---|---|---|
| used after keeping at 25° C. | 5 | 3.7 | 3 | 2.3 |
| used after keeping at 30° C. | 4.8 | 3.5 | 2.5 | 1.5 |
| used after keeping at 45° C. | 4.7 | 3.4 | 2.2 | 1 |

Referring to Table 1 and FIG. 14, since the cosmetic vessel 11 according to the present invention includes the discharge unit 120 including the pump 120 (specifically, airless pump) or an impregnated sponge, and the discharge plate 150, there may be two different embodiments, depending on the type of the discharge unit 120. In addition, the conventional cosmetic vessel may be divided into a case in which cosmetics are discharged by the airless pump and a case in which cosmetics are discharged by the impregnated sponge.

It showed that the highest level of user satisfaction was achieved against the embodiment corresponding to the cosmetic vessel 11 including the airless pump 120 and the metallic discharge plate 150 when the cosmetic vessel 11 according to the present invention was used after being kept at each temperature in comparison with the other embodiment according to the present invention or the conventional cosmetic vessels.

In addition, user satisfaction with the embodiment corresponding to the cosmetic vessel 11 including the impregnated sponge and the metallic discharge plate 150 when the cosmetic vessel 11 was used after being kept at each temperature was higher than that of the conventional cosmetic vessel.

Since the metallic discharge plate 150 effectively cools the cosmetics discharged from the airless pump 120 or the impregnated sponge, the user satisfaction with the cooling effect of the cosmetic vessel 11 according to the present invention was higher than that with the conventional cosmetic vessel. On the other hand, since the conventional cosmetic vessel including either the airless pump or the impregnated sponge cannot cool the cosmetics, a lower level of user satisfaction was obtained.

The cooling effect produced by the cosmetic vessel 11 is shown with reference to Table 2 below and FIG. 15.

TABLE 2

| | 0 | 15 | 30 | 45 | 60 | (sec) |
|---|---|---|---|---|---|---|
| Airless pump + metallic discharge plate | 45.8 | 40 | 38.1 | 31 | 27.5 | ° C. |
| Impregnated sponge + metallic discharge plate | 46.4 | 43 | 41.3 | 35 | 31.1 | ° C. |
| Airless pump | 47 | 45 | 42.6 | 38.5 | 35.2 | ° C. |
| Impregnated sponge | 47.4 | 46.5 | 43.7 | 41.7 | 39.6 | ° C. |

Table 2 shows temperatures of surfaces (on which the user picks up cosmetics with a puff. The surfaces of the cosmetic vessels refer to the top surfaces of the discharge plate 150 of the cosmetic vessel 11 according to the present invention, a discharge portion of the airless pump of the conventional cosmetic vessel, and the top surface of the impregnated sponge of the conventional cosmetic vessel) of the cosmetic vessel 11 and the conventional cosmetic vessel measured by time after the cosmetic vessel 11 and the conventional cosmetic vessel were kept at a predetermined temperature (50° C.) for a predetermined period of time (the cosmetic vessel 11 and the conventional cosmetic vessel were kept in an incubator until the temperature of the incubator was completely transferred to each vessel for four hours in these experiments), and then left at room temperature (of 20° C.) for one minute. An average of three values for each embodiment was calculated. FIG. 15 is a graph of the values shown in Table 2.

Referring to Table 2 and FIG. 15, as for the embodiment corresponding to the cosmetic vessel 11 including the airless pump 120 as the discharge unit 120, the temperature of the surface was sharply reduced when observed at 15-second intervals one minute after being left at room temperature. It showed that the surface temperature was cooled to a temperature of 27.5° C. after 60 seconds passed.

Alternately, as for the embodiment corresponding to the cosmetic vessel 11 including the impregnated sponge as the discharge unit 120, it showed that the surface temperature was sufficiently reduced. The surface was cooled to a temperature of 31.1° C. after 60 seconds passed.

However, when the conventional cosmetic vessel was kept to reach 50° C. and then exposed to room temperature, since the conventional cosmetic vessel did not include any configuration to sharply reduce the temperature, the conventional cosmetic vessel including the airless pump was maintained at the temperature of 35° C. or higher after 60 seconds, and the conventional cosmetic vessel including the impregnated sponge was maintained at the temperature of approximately 40° C. after 60 seconds.

In other words, based on the above-shown experimental data, when the cosmetic vessel 11 was heated to the temperature of 50° C. and exposed at room temperature of 20° C., the metallic discharge plate 150 caused a sharp temperature reduction, so that a cooling effect was provided on the cosmetics discharged to the top surface of the discharge plate 150. Therefore, the cooling effect produced by the cosmetic vessel 11 was clearly shown based on the measured temperatures, which makes the cosmetic vessel 11 according to the present invention distinguished from the conventional cosmetic vessel. As a result, according to the present invention, user satisfaction may be significantly improved.

However, the temperature was more reduced when the cosmetic vessel 11 includes the airless pump 120 as the discharge unit 120 than when the cosmetic vessel 11 includes the impregnated sponge as the discharge unit 120. Such difference was made since there was little or no contact area between the airless pump 120 and the discharge plate 150 and the heat absorbed into the cosmetics when the cosmetic vessel 11 was kept at the temperature of 50° C. was not transferred to the discharge plate 150.

As described above, since the discharge plate 150 of the cosmetic vessel 11 according to the present invention includes a metallic material, a sharp temperature reduction occurs at the top surface of the discharge plate 150, so that the heat in the cosmetics may be dissipated to the outside when the cosmetics is discharged to thereby maximize user satisfaction against a cooling effect.

Hereinafter, the antimicrobial effect of the cosmetic vessel 11 according to the present invention will be proved and described using the specific experimental data.

Figure 16:
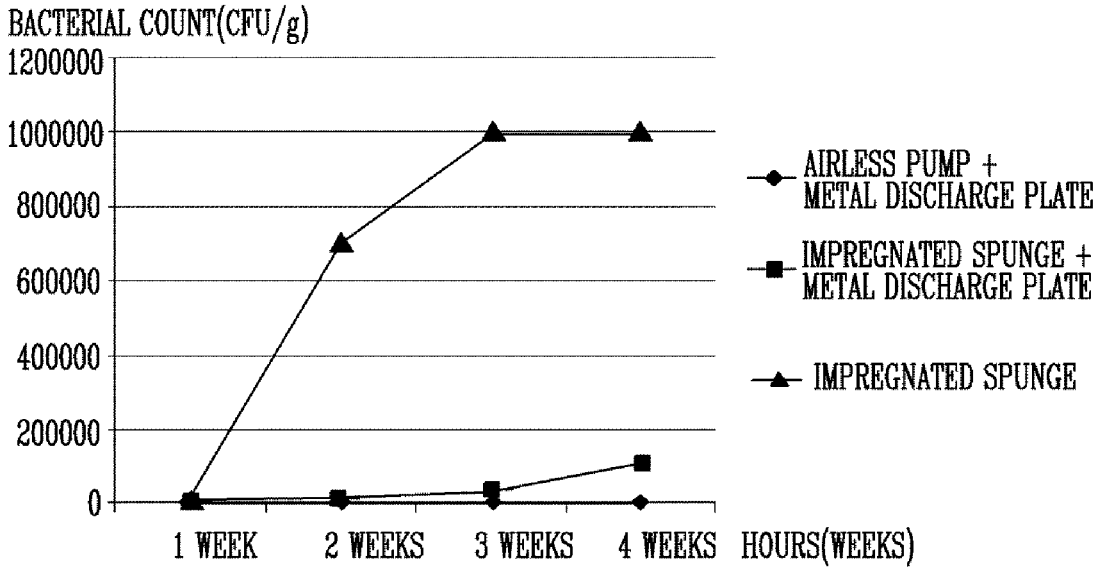
FIG. 16 is a graph showing propagation of bacteria in a cosmetic vessel according to the present disclosure.
Figure 17:
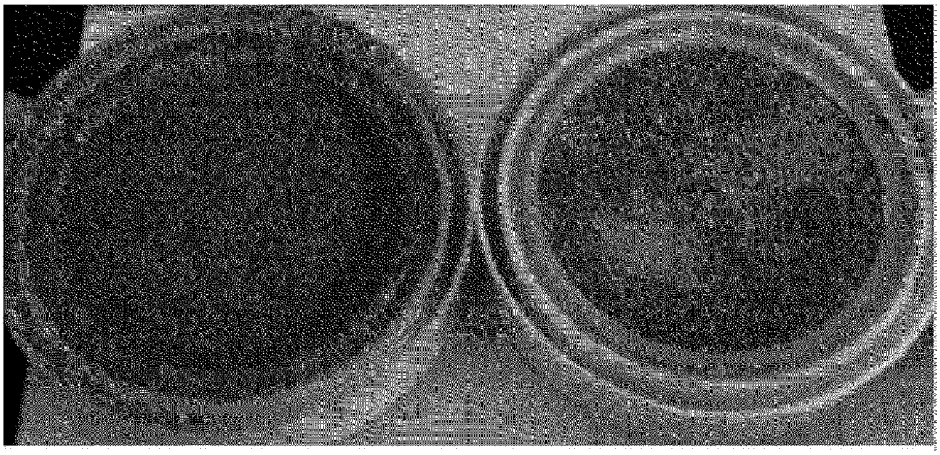
FIG. 17 is a view showing contamination of a conventional impregnated sponge.

FIG. 16 is a graph illustrating propagation of bacteria of a cosmetic vessel according to the present invention. FIG. 17 is a view illustrating contamination of a conventional impregnated sponge. Table 3 shows propagation number of bacteria of a cosmetic vessel according to the present invention and a conventional cosmetic vessel. FIG. 16 is a graph of the values shown in Table 3.

In the experiments in FIG. 16 and Table 3, cosmetics with no preservatives were used. The experiments were performed on the cosmetic vessel 11 including the airless pump 120 as the discharge unit 120 and the cosmetic vessel 11 including the impregnated sponge as the discharge unit 120. The conventional cosmetic vessel including the impregnated sponge was used as a comparison group. In addition, the user applied the cosmetics of the cosmetic vessel with a puff for four weeks.

In addition, in the experiments in FIG. 17, the user applied a sunscreen (containing disodium phenylbenzimidazole sulfonic acid which is fluorescent under a UV lamp) and used the cosmetics on the impregnated sponge for a week or two according to the general directions. Whether or not the sunscreen remained on the impregnated sponge was checked using a UV lamp.

TABLE 3

| Configuration | $1^{st}$ week | $2^{nd}$ week | $3^{rd}$ week | $4^{th}$ week |
|---|---|---|---|---|
| Airless pump + metallic discharge plate | 20 | 20 | 20 | 20 |
| Impregnated sponge + metallic discharge plate | 20 | 10,000 | 30,000 | 100,000 |
| Impregnated sponge | 10,000 | 700,000 | 1,000,000 | 1,000,000 |

Since the cosmetic vessel 11 according to the present invention includes the metallic discharge plate 150, although the user applies the cosmetics discharged to the discharge plate 150 with the puff, dead skin cells or the like on the puff may not be introduced into the discharge unit 120, except through the discharge holes 151 of the discharge plate 150. Therefore, as shown in Table 3 and FIG. 16, the cosmetic vessel 11 showed little or no bacterial propagation in comparison with the conventional cosmetic vessel which did not include the discharge plate 150.

Since the discharge holes 151 of the discharge plate 150 of the cosmetic vessel 11 according to the present invention have a sufficiently small diameter (of 1 mm or less), even when the discharge unit 120 structurally communicates with the outside through the discharge holes 151, it may be very difficult to provide nutrients, such as dead skin cells, to bacteria. In addition, when the cosmetic vessel 11 includes the airless pump 120, the discharge holes 151 may not coincide with the outlet of the airless pump 120, so that supply of the nutrients may be completely blocked. Therefore, when the cosmetic vessel 11 used the airless pump 120, it showed that no bacterial propagation was observed.

On the other hand, as for the conventional cosmetic vessel using the impregnated sponge, the entire top surface of the impregnated sponge is exposed to the outside, and the puff directly contacts the impregnated sponge. Therefore, dead skin cells or the like on the puff continue to be provided to bacteria of the impregnated sponge. In other words, since the cosmetics were discharged from the impregnated sponge by the puff, rapid bacteria growth was observed.

With reference to FIG. 17, as the user kept applying the cosmetics on the impregnated sponge with the puff, it clearly showed that the sunscreen on the user's skin was transferred to the impregnated sponge. Thus, user's dead skin cells were also transferred to the impregnated sponge, which promoted continuous bacterial growth in the conventional cosmetic vessel.

On the other hand, according to the present invention, the discharge plate 150 of the cosmetic vessel 11 may effectively prevent the puff from directly contacting the discharge unit 120. When the cosmetic vessel 11 uses the airless pump 120, even if the user keeps applying the cosmetics with the puff, introduction of dead skin cells into the cosmetics received in the airless pump 120 is structurally impossible.

As described above, since the cosmetic vessel 11 includes the discharge plate 150 having the discharge holes 151 with a small diameter, the puff does not directly contact the outlet of the discharge unit 120. Thus, when the user applies makeup using the puff, supply of nutrients through the puff to bacteria remaining in the cosmetics may be prevented to thereby completely block contamination of the cosmetics.

Table 4 below shows the number of surviving bacteria in the cosmetic vessel 11. The experiments were performed by inoculating the cosmetics in the discharge unit 120 of the cosmetic vessel 11 according to the present invention with bacteriomycota (colon *bacillus*, pyogenic *bacillus*, and *Pseudomonas aeruginosa*) or eumycetes (*Aspergillus niger* and *Candida albicans*) and determining the number of living cells on a daily basis.

The number of bacteria was obtained by taking a 1 gram sample of the cosmetics, diluting the sample with a neutralization liquid ten times, smearing it on an SDC medium, culturing it in an incubator at 37° C. for 24 hours or more, and observing the number of colonies (the number of bacteria). The number of fungus was obtained by taking a 1 gram sample of the cosmetics, diluting the sample with a neutralization liquid ten times, smearing it on an SDA medium, culturing it in an incubator at 30° C. for 24 hours or more, and observing the number of colonies (the number of fungus).

TABLE 4

| Discharge unit | Initial | 1st day | 2nd day | 3rd day | 4th day |
|---|---|---|---|---|---|
| Bacteriomycota (CFU/g) | | | | | |
| Airless pump | 8.0*10^6 | 1200 | less than 20 | less than 20 | less than 20 |
| Impregnated sponge | | 400000 | 20000 | 8000 | 400 |
| Eumycetes (CFU/g) | | | | | |
| Airless pump | 6.0*10^5 | 200 | less than 20 | less than 20 | less than 20 |
| Impregnated sponge | | 30000 | 8000 | 720 | 160 |

The cosmetic vessel 11 according to the present invention may include the airless pump 120 or the impregnated sponge as the discharge unit 120. However, the airless pump 120 prevents air inlet, whereas the impregnated sponge may allow inlet of a certain amount of air.

Referring to Table 4, when the discharge unit 120 of the cosmetic vessel 11 was the airless pump 120, the number for each of the bacteriomycota and eumycetes was sharply reduced to less than 20 on the second day. Nutrients that bacteria need for survival were not supplied since the airless pump 120 prevents air inlet to the cosmetics received therein.

On the other hand, when the discharge unit 120 of the cosmetic vessel 11 was the impregnated sponge, the number of living cells for each of bacteriomycota and eumycetes was greater than that obtained when the airless pump 120 was used.

In other words, according to the above experimental results, since the cosmetic vessel 11 uses the airless pump 120 instead of the impregnated sponge as the discharge unit 120, the number of surviving bacteria may be minimized to significantly prevent contamination of the cosmetics.

Hereinafter, durability and hygiene of the cosmetic vessel 11 are described using the specific experimental data.

Figure 18:
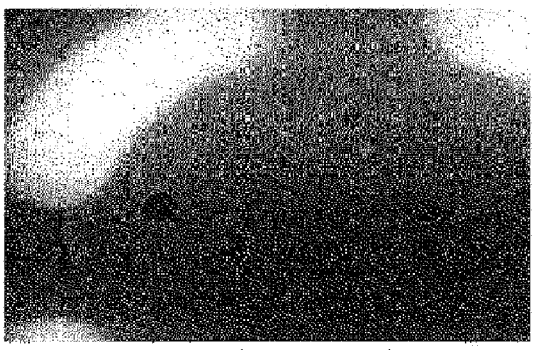
FIG. 18 is a view showing wear according to material of a discharge plate of a cosmetic vessel according to the present disclosure.
Figure 18:
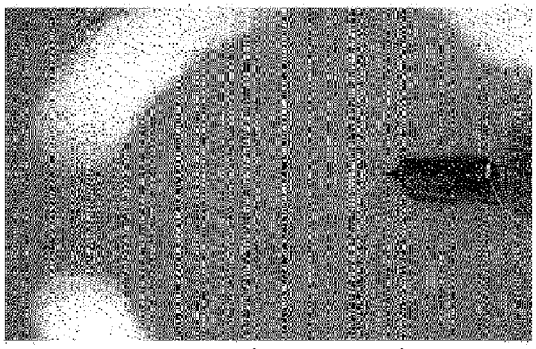
Figure 18:
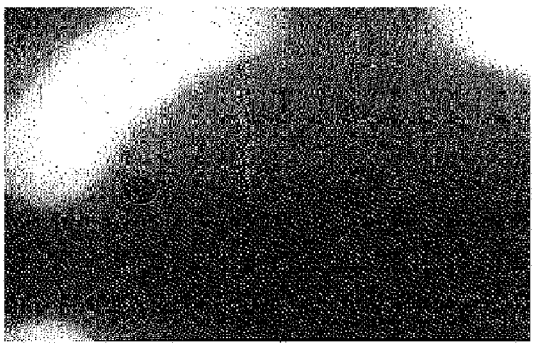
Figure 18:
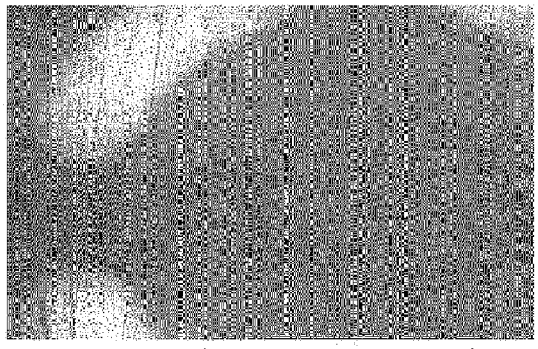

FIG. 18 is a view showing wear depending on a material of a discharge plate of a cosmetic vessel according to the present invention.

In the experiments in FIG. 18, the discharge plate 150 of the cosmetic vessel 11 included an SUS 304 stainless steel, and the discharge plate 150 including general plastics was used as a control group.

As shown in FIG. 18, when the top surface of the discharge plate 150 from which the cosmetics is discharged was rubbed twenty times by the puff, the metallic discharge plate 150 was not scratched at all. However, it clearly showed that the plastic discharge plate 150 was badly scratched after being used only twenty times.

In other words, since the discharge plate 150 of the cosmetic vessel 11 according to the present invention includes a metal instead of plastics, the discharge plate 150 may be prevented from wearing down when the cosmetics on the top surface of the discharge plate 150 is rubbed with the puff. In addition, since the present invention suppresses the generation of scratches, the cosmetic vessel 11 may ensure durability and hygiene in comparison with the conventional cosmetic vessel which spoils the beauty of the cosmetic vessel and accelerates contamination.

The cosmetics used in the cosmetic vessel 11 may contain an inorganic pigment having solid particles such as calcium carbonate (CaCO3), titanium oxide (TiO2), talc, a natural mineral, a metal compound, etc. Since the cosmetics include the inorganic pigment having a high hardness, when the cosmetics is spread over the top surface of the discharge plate 150 by the puff, the discharge plate 150 may wear down. Therefore, the discharge plate 150 of the cosmetic vessel 11 may have a Vickers hardness ranging from 120 HV to 200 HV. Here, Vickers hardness refers to a value obtained by performing an ASTM E92 Vickers hardness test. Diamond is pressed into a test sample, and an area corresponding to the resulting indentation was quantified to obtain a Vickers hardness value.

Therefore, in the present invention, since the discharge plate 150 has a Vickers hardness of 120 HV or more, even when the cosmetics contain the inorganic pigment having a high hardness, the discharge plate 150 may be prevented from being scratched or wearing down when friction is caused by the puff. In addition, in the present invention, since the discharge plate 150 has a Vickers hardness of 200 HV or less, manufacturing costs of the discharge plate 150 may be optimized, and processing and forming (an etching process performed to form the discharge holes 151) may be facilitated.

In addition, according to the present invention, since the top surface of the discharge plate 150 is exposed to the outside and the user applies the cosmetics discharged to the top surface of the discharge plate 150 with the puff, the surface of the discharge plate 150 onto which the user presses the puff to pick up the cosmetics is separated from the discharge unit 120, so that the surface onto which the puff is pressed may be cleaned at any time to keep the discharge plate 150 clean.

As shown in Table 5 below, fifty users evaluated hygiene and gave grades on a scale of zero to five with respect to the cosmetic vessel 11 including the airless pump 120 or the impregnated sponge as the discharge unit 120 and the conventional cosmetic vessel including either the airless pump or the impregnated sponge. In terms of hygienic aspect, the cosmetic vessel 11 received higher grades than the conventional cosmetic vessel. More specifically, when compared with the conventional cosmetic vessel including only the impregnated sponge, the cosmetic vessel 11 including the discharge plate 150 according to the present invention may improve hygiene.

TABLE 5

| | Airless pump + metallic discharge plate | Impregnated sponge + metallic discharge plate | Airless pump | Impregnated sponge |
|---|---|---|---|---|
| Usage satisfaction (hygiene) | 5 | 4.5 | 4 | 1 |

Therefore, since the cosmetics discharged from the discharge unit 120 are discharged to the top surface of the discharge plate 150, and the remaining cosmetics on the top surface of the discharge plate 150 exposed to the outside may be cleaned, hygiene may be improved in comparison with the conventional cosmetic vessel. As a result, the user may avoid skin problems.

As described above, the present invention has an excellent cooling effect according to the user satisfaction with cooling and the experimental data on surface temperature changes, ensures antimicrobial properties according to the experimental data on the number of surviving bacteria and the propagation number of bacteria, and secures durability and hygiene according to the experimental data on the generation of scratches and user satisfaction with hygiene. Therefore, the present invention may maximize user satisfaction.

The present disclosure may include a fifth embodiment where the discharge plate 150 is made of a nonmetallic material instead of a metallic material. Herein, the discharge plate 150 may be made of at least one material selected from a group including plastic, wood, MDF, nonmetallic mineral, paper, silicon, ceramic, rubber, and glass.

Alternatively, the discharge plate 150 may be made of at least one material selected from a group including polyurethane, polyethylene, polyester, polyether, polypropylene, polystyrene, ABS, SAN, acryl, polyimide, polycarbonate, polyethyleneterephthalate, and nylon.

In this case, it can be regarded that the discharge plate 150 of a nonmetallic material is made of a non-current-carrying material, and in the case where the user rubs a puff on the discharge plate 150 in order to apply the cosmetics exposed on the top surface of the discharge plate 150, such a discharge plate 150 made of a non-current-carrying material may prevent static electricity from being generated due to friction between the puff and the discharge plate 150.

That is, since the discharge plate 150 is made of a non-current-carrying material, the discharge plate 150 may restrict generation of static electricity in the case of friction with the puff to rub the discharged cosmetics. However, the discharge plate 150 may be made of a nonmetallic material, but that has a higher hardness than an inorganic pigment made of solid particles included in the cosmetics. In such a case, even if the discharge plate 150 is made of a plastic material, scratches as that in FIG. 18 may not be generated.

Figure 19:
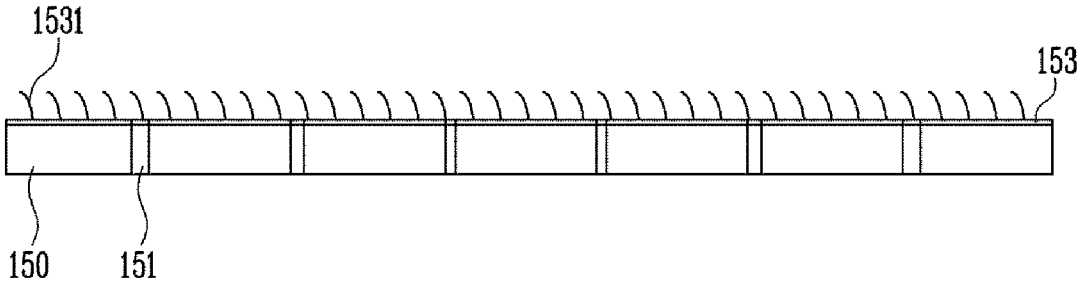
FIGS. 19 and 20 are cross-sectional views of a discharge plate of a cosmetic vessel according to the sixth embodiment of the present disclosure.
Figure 20:
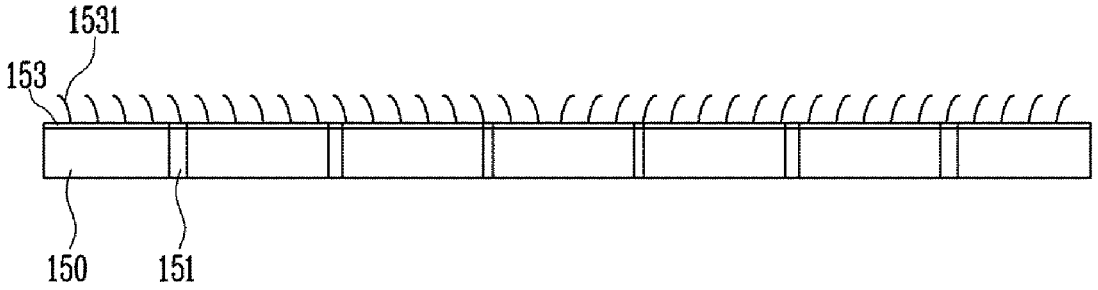

FIGS. 19 and 20 are cross-sectional views of a cosmetic vessel according to a sixth embodiment of the present disclosure.

Referring to FIGS. 19 and 20, the discharge plate 150 of the cosmetic vessel 11 according to the sixth embodiment of the present disclosure may be provided with a fiber material 153 on at least a portion of at least one surface thereof. The fiber material 153 may be provided on a top surface and/or bottom surface and/or side surface of the discharge plate 150, for example on at least a portion that includes a central portion on the top surface. Herein, the discharge plate 150 may be made of a metallic material or nonmetallic material, and there is no limitation to the material of the discharge plate 150 in the present embodiment.

The fiber material 153 may be provided on one surface of the discharge plate 150 in a coupling method using an ultrasonic welding method, or thermocompression method, or by using an adhesive, or in a method of covering the one surface of the discharge plate 150. Otherwise, the fiber material 153 may be mounted on the top surface of the discharge plate 150, and then be coupled to the discharge plate 150 through an additional frame (not illustrated) configured to press and fixate the rim of the discharge plate and the fiber material 153. In such a case, the fiber material 153 corresponding to a size area of the discharge plate 150 may be prepared, and then the fiber material 153 may be coupled to the discharge plate 150 in an adhesion method or covering method, and thus it is possible to save the manufacturing cost and cover the fiber material 153 uniformly, which is an advantage. Of course, the method of providing the fiber material 153 is not limited to the aforementioned methods in the present embodiment.

The fiber material 153 provided on the discharge plate 150 may be made of at least one material selected from a group including natural fiber, artificial fiber, metallic fiber, and glass fiber. As such, since in the present embodiment, the fiber material 153 is provided on one surface (particularly, top surface) where the cosmetics is discharged on the discharge plate 150, when the user rubs the top surface of the discharge plate 150 using the puff, the user may feel a soft touch.

Therefore, since the user may wear makeup while feeling a soft sense as the fiber material 153 and puff rub each other, the user may feel convenience and stability.

Examples of natural fiber that may form the fiber material 153 include hemp, silk, wool, and cotton; examples of artificial fiber that may form the fiber material 153 include fiber rayon, acetate, nylon, polyester, acryl, urethane, viscose, and tencel; and examples of metallic fiber that may form the fiber material 153 include gold threads, silver threads, and steel threads.

Otherwise, the fiber material 153 may be formed by way of flocking processing. Flocking processing is a method of planting individual fibers 1531 on the top surface of the discharge plate 150 on which an adhesive is applied through the static electricity principle. Herein, the individual fibers 1531 may be formed in a variety of colors and arrangements. Especially, the individual fibers 1531 may be formed to be inclined in one direction from one end to another end of the discharge plate 150. That is, all the individual fibers 1531 forming the fiber material 153 may be inclined to be parallel to one another as illustrated in FIG. 19.

Otherwise, as illustrated in FIG. 20, the individual fibers 1531 may be formed to be inclined in a direction away from the center of the discharge plate 150 from an end attached to the discharge plate 150 to another end. That is, the individual fibers 1531 may be inclined radially, or to the contrary, inclined in a direction towards the center of the discharge plate 150.

Herein, in order to prevent the cosmetics from remaining unnecessarily in the space between the individual fibers 1531 forming the fiber material 153, the fiber material 153 may be formed to have a height that is relatively smaller than the thickness of the discharge plate 150.

As aforementioned, in the present embodiment, it is possible to form the fiber material 153 on the top surface of the discharge plate 150 through flocking processing and the like, so that the user may feel a soft touch when applying the cosmetics using the puff thereby improving user satisfaction.

Figure 21:
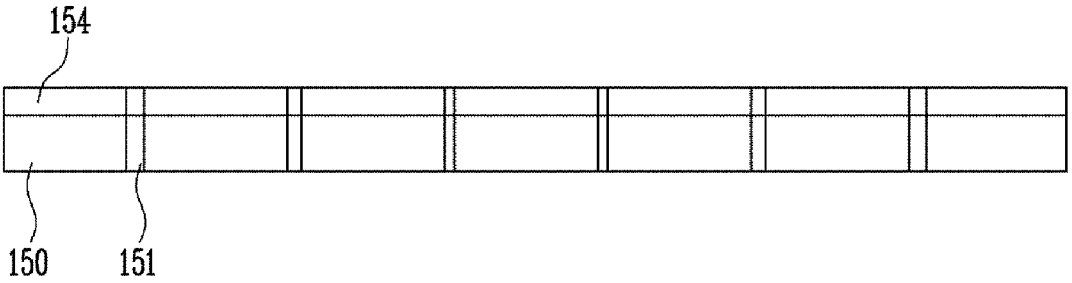
FIGS. 21 and 22 are cross-sectional views of a discharge plate of a cosmetic vessel according to the seventh embodiment of the present disclosure.
Figure 22:
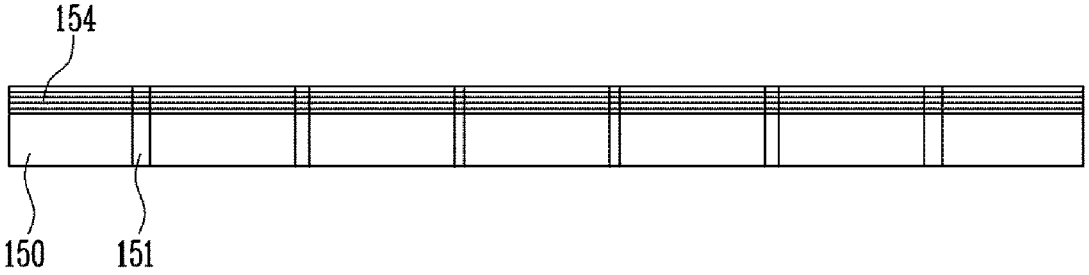

FIGS. 21 and 22 are cross-sectional views of a discharge plate of a cosmetic vessel according to a seventh embodiment of the present disclosure.

Referring to FIGS. 21 and 22, the discharge plate 150 of the cosmetic vessel 11 according to the seventh embodiment of the present disclosure may be provided with a thin film 154 on at least a portion of one surface thereof. The thin film 154 may be provided on the top surface and/or bottom surface and/or side surface of the discharge plate 150, for example on at least a portion that includes the central portion on the top surface. However, the one surface provided with the thin film 154 may be the surface where the cosmetics is discharged through the discharge hole 151.

Herein, the discharge plate 150 may be made of a metallic material or nonmetallic material as explained with reference to the sixth embodiment above. That is, there is no particular limitation to the material of the discharge plate 150 in the present embodiment.

The thin film 154 may be a thin film of a metallic material. That is, the thin film 154 may be a metallic film of which the material is selected from a variety of materials including gold, silver, bronze, copper, chromium, and hologram.

The thin film 154 may be a sticker film attached to one surface of the discharge plate 150. Herein, the sticker film may be laminated in a plurality of layers on one surface of the discharge plate 150 in a removable manner as illustrated in FIG. 22.

This is to enable the user to easily remove the thin film 154 in case the thin film 154 is damaged by friction with the puff. That is, when the thin film 154 is laminated in a plurality of layers, the user may remove the plurality of thin films 154 one at a time according to use period thereby renewing the appearance. In such a case, the plurality of thin films 154 being laminated may have different colors or patterns. That is, the top surface of the discharge plate 150 may change every time the user removes the thin film 154.

Furthermore, when a plurality of thin films 154 are laminated, an identifying element may be illustrated on the thin films 154 to indicate the number of layers. Herein, the identifying element may be a character such as a number, or a color of which the brightness or chroma increases or decreases sequentially.

The thin film 154 may be formed to have a thickness that is relatively thinner than the thickness of the discharge plate 150. This is because in a case where the thin film 154 is provided in a removable manner, if the thin film 154 is thick, the user may feel a sense of difference and thus inconvenience when removing the thin film 154.

The thin film 154 may have a thickness of for example 1 to 50 micrometers. More specifically, the thin film 154 may have a thickness of less than 10 micrometers. Of course, there is no particular limitation to the thickness of the thin film 154 as long as it is sufficiently smaller than the thickness of the discharge plate 150.

The present disclosure may further include an eighth embodiment wherein paint is applied and coated on at least a portion of at least one surface of the discharge plate 150. Herein, the coating may be formed on the top surface and/or bottom surface and/or side surface of the discharge plate 150, for example on at least a portion that includes the central portion on the top surface. However, the one surface where the coating is formed may be the one surface where the cosmetics is discharged through the discharge hole 151. Herein, the material of the discharge plate 150 may be a metallic or nonmetallic material.

The paint may include a solvent, and may further include a remaining component to be coated on the discharge plate 150 selected from at least one of a group including ceramic, metal, plastic, glass, paper, rubber, and silicon.

In the present embodiment, the paint including the solvent may be sprayed on the discharge plate 150 and then dried to remove the solvent so that a remaining component, that is, ceramic or etc included in the paint may be coated on one surface of the discharge plate.

More specifically, by going through a process of spraying paint, drying, UV painting, and UV curing after washing the top surface of the discharge plate 150, it is possible to coat the top surface of the discharge plate 150 with an ingredient such as ceramic or etc included in the paint.

Herein, the paint may coat one surface of the discharge plate 150 in at least one method selected from a group including mat coating, glossy coating, pearl coating, metal coating, and hologram coating, or in at least one method selected from a group including rubber coating, embossing coating, photosensitive coating, thermosensitive coating, and phosphorescent coating.

As aforementioned, the present embodiment may coat the top surface of the discharge plate 150 with ceramic or etc through paint spraying and drying, thereby improving the appearance and providing various colors and patterns to the top surface of the discharge plate 150. Furthermore, the present embodiment may improve oxidation resistance, chemical resistance, and abrasion resistance, thereby preventing contamination of the cosmetics and securing stability of skin, and also preventing the coating from peeling off even if the friction with the puff is repeated numerous times.

Figure 23:
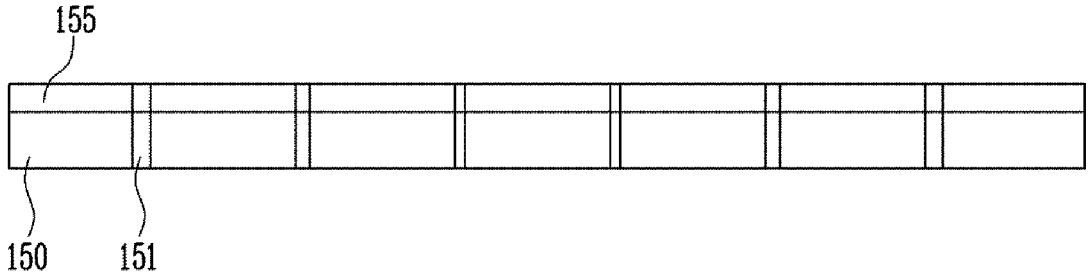
FIG. 23 is a cross-sectional view of a discharge plate of a cosmetic vessel according to the ninth embodiment of the present disclosure.

FIG. 23 is a cross-sectional view of a discharge plate of a cosmetic vessel according to a ninth embodiment of the present disclosure.

Referring to FIG. 23, the discharge plate 150 of the cosmetic vessel 11 according to the ninth embodiment of the present disclosure may be made of a metallic or nonmetallic material, and an outer plate or outer surface 155 may be provided on at least a portion of at least one surface of the discharge plate 150 by laminating or plating. The outer surface 155 may be provided on the top surface and/or bottom surface and/or side surface of the discharge plate 150, for example, on at least a portion that includes the central portion of the top surface. However, the one surface where the outer surface 155 is provided may be one surface where the cosmetics is discharged through the discharge hole 151.

Herein, the outer surface 155 may be plated with at least one material selected from a group including gold, silver, bronze, nickel, steel, chromium, aluminum, copper, zinc, and tin.

In this case, the present embodiment may apply metal on the surface of the discharge plate 150 to beautify the appearance, thereby increasing the added value of the cosmetic vessel 11. Herein, the outer surface 155 may be formed by at least one of electroplating, chemical plating, and hot dipping.

Otherwise, the outer surface 155 may be formed by solidifying a gas state material and laminating it on the one surface of the discharge plate. Herein, the outer surface 155 may be formed by laminating at least one material selected from a group including gold, silver, bronze, nickel, steel, chromium, aluminum, copper, zinc, and tin.

In the case of forming the outer surface by lamination, the lamination may be conducted in a PVD (Physical Vapor Deposition) or CVD (Chemical Vapor Deposition) method. The PVD is a method for gasifying a solid material using an electron beam, laser beam or plasma in a vacuum state, and then condensing/crystallizing the gasified material on a top surface of the discharge plate 150. Herein, metal such as aluminum, gold, silver, copper or etc. may be laminated. On the other hand, the CVD is a method for transforming a material to be laminated into a gas material and then attaching the gas material on a top surface of the discharge plate 150 in a gasification reaction.

Of course, in the present embodiment, a metal material may be laminated on the top surface of the discharge plate 150 in various well known methods besides the aforementioned two methods to form the outer surface 155.

In the present embodiment, the cooling effect mentioned in the first embodiment may be obtained by forming the outer surface 155 of a metal material even when using a nonmetallic material discharge plate 150, and user satisfaction may be maximized through beautified appearance.

Besides the aforementioned first to ninth embodiments, the present disclosure may include an embodiment where at least one of the first to ninth embodiments is selected and combined, and when forming a fiber material 153, thin film 154 or outer surface 155 in the sixth to ninth embodiments or when coating the one surface of the discharge plate 150, by forming a hole or path communicating with the discharge hole 151 on the fiber material 153, thin film 154, and outer surface 155 so as not to close the discharge hole 151, it is possible to facilitate the discharging of the cosmetics.

Furthermore, in the sixth to ninth embodiments, a portion processed by a fiber material, thin film, sticker film, coating, plating, or laminating may be referred to as a discharge plate processed portion made of a material different from that of the discharge plate 150.

Furthermore, in the fifth embodiment, at least a portion of one surface of the discharge plate 150 may be made of a nonmetallic material. Herein, the portion made of the nonmetallic material may be referred to as a discharge plate processed portion made of a material different from that of the discharge plate 150.

Figure 24:
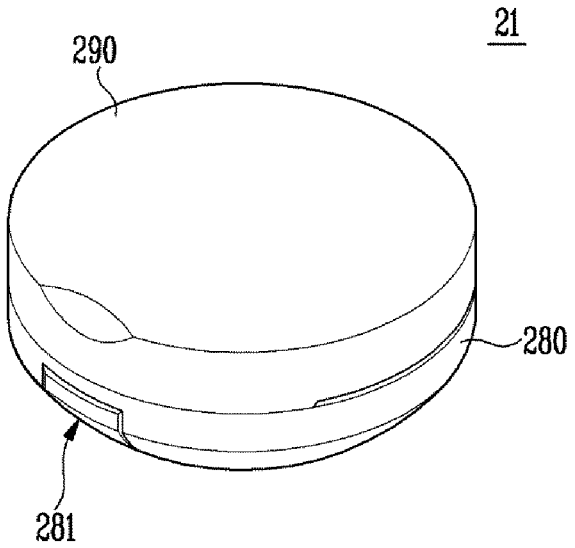
FIGS. 24 and 25 are perspective views of a cosmetic vessel according to a tenth to fourteenth embodiment of the present disclosure.
Figure 25:
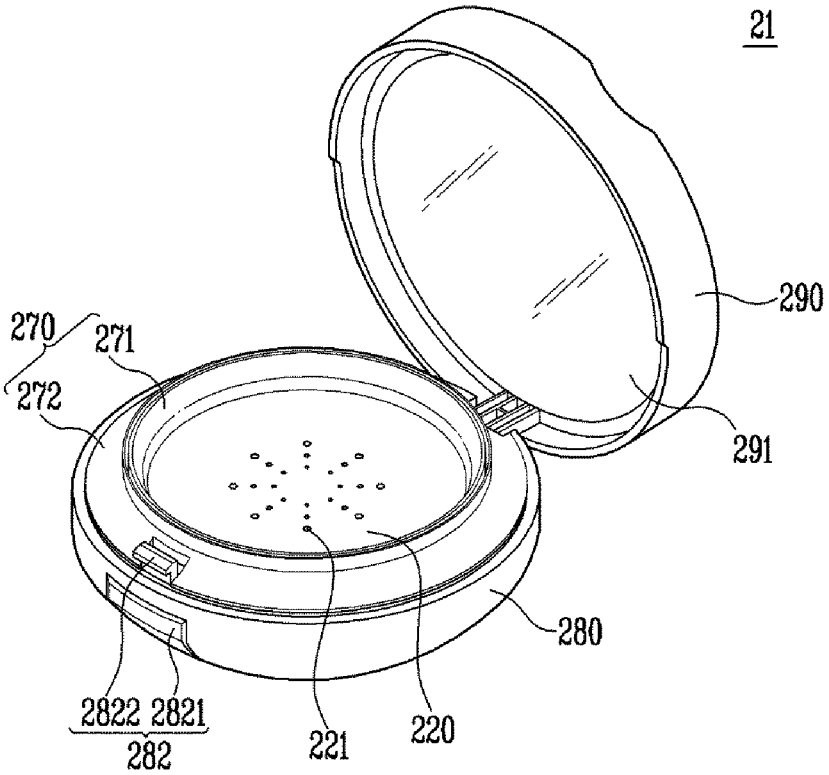

FIGS. 24 and 25 are perspective view of a cosmetic vessel according to a tenth to fourteenth embodiment of the present disclosure. FIG. 24 illustrates a state where a lid 290 is closed, whereas FIG. 25 illustrates a state where the lid 290 is opened.

Figure 26:
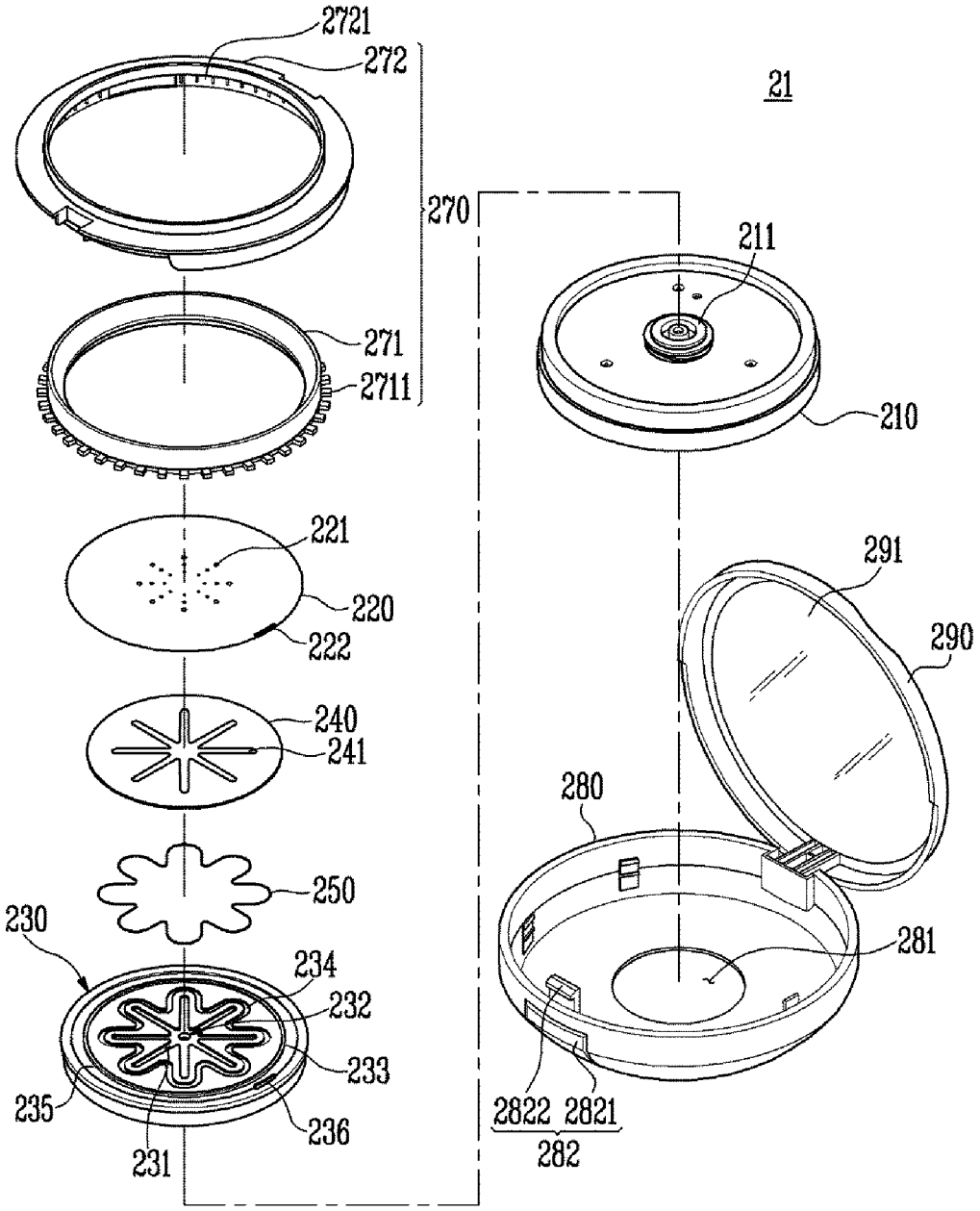
FIG. 26 is an exploded perspective view of a cosmetic vessel according to the tenth embodiment of the present disclosure.
Figure 31:
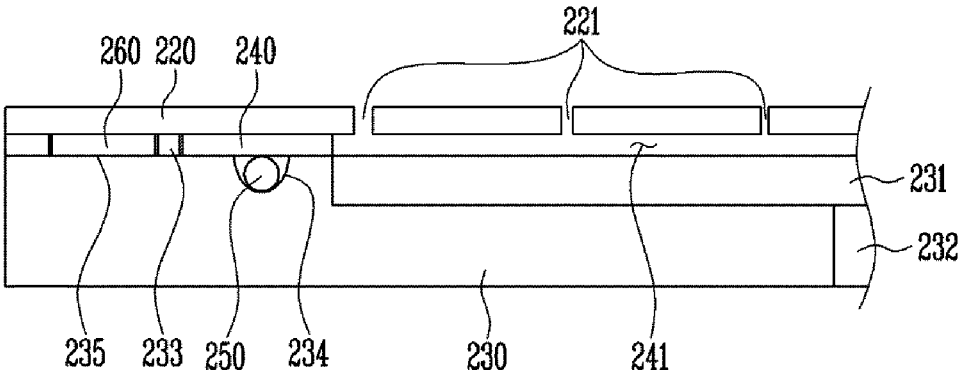
FIG. 31 is a partial cross-sectional view of a cosmetic vessel according to the tenth embodiment of the present disclosure.

Furthermore, FIG. 26 is an exploded perspective view of a cosmetic vessel according to the tenth embodiment of the present disclosure, and FIG. 31 is a partial cross-sectional view of a cosmetic vessel according to the tenth embodiment of the present disclosure.

Referring to FIGS. 24 to 26 and FIG. 31, the cosmetic vessel 21 according to the tenth embodiment of the present disclosure includes a discharge unit 210, a discharge plate 220, a diffusion portion 230, a close contact surface 240, a packing material 250, 260, a rim portion 270, an outer cover 280, and a lid 290.

The discharge unit 210 discharges cosmetics. The discharge unit 210 may be an airless pump 210 configured to accommodate cosmetics inside and to discharge the cosmetics to the outlet 211 by a user manipulation and the like.

In a case where the discharge unit 210 is an airless pump 210, the discharge unit 210 may discharge the cosmetics using a piston (not illustrated) that goes up and down inside a cylinder (not illustrated). The detailed structure of the airless pump 210 such as the cylinder and piston is generally well known, and thus detailed explanation will be omitted.

The cosmetics accommodated in the discharge unit 210 may be liquid or a mixture of liquid and solid. It may be a composition made of various ingredients such as lotion or UV sun block. That is, there is no particular limitation to the ingredients, state or purpose of the cosmetics that may be used in the present disclosure.

The discharge unit 210 discharges cosmetics through the outlet 211. Herein, the outlet 211 of the discharge unit 210 may be elevated by a separately provided elastic member (not illustrated). When the outlet 211 of the discharge unit 210 is pressurized downwards by the discharge plate 220 to be explained below, cosmetics may be discharged towards outside through the outlet 211 according to the general principles of the airless pump 210.

The discharge unit 210 has a certain size, and thus when the amount of cosmetics stored inside the discharge unit 210 is reduced, the empty space may increase gradually. However, in order not to form an empty space where the cosmetics exists, a press plate (not illustrated) may be provided inside the discharge unit 210.

The press plate prevents the internal pressure from falling as the cosmetics is being discharged through the outlet 211 of the discharge unit 210 so that air is not introduced into the discharge unit 210.

The press plate ascends or descends as the cosmetics is being discharged, thereby maintaining a constant pressure in the space where the cosmetics is stored. Herein, in order to enable the press plate to ascend, an air inlet (reference numeral not indicated) may be provided at one side of the discharge plate 210 to let the air in.

That is, when the cosmetics is discharged from the discharge unit 210, the press plate may ascend or descend so as to reduce the space between the cosmetics and the outlet 211 according to the amount of cosmetics discharged. By doing this, the present embodiment keeps the cosmetics inside the discharge unit 210 from contacting air, thereby preventing the cosmetics from contamination.

Furthermore, in the present embodiment, a sponge impregnated with liquid cosmetics may be used as the discharge unit 210 instead of the airless pump 210. When pressurized by the diffusion portion 230, the sponge may discharge the cosmetics accommodated inside to the diffusion space 231 of the diffusion portion 230.

Since the cosmetics may be discharged upwards from an entirety of the top surface as the sponge is pressurized, the present embodiment may have a press plate (not illustrated) communicating with the diffusion space 231 of the diffusion portion 230 when using the sponge as the discharge unit 210. The press plate may be provided such that it covers the entirety of the top surface of the sponge and presses the sponge, and the cosmetics being discharged from the sponge may be supplied only to the diffusion space 231 of the diffusion portion 230, thereby preventing the cosmetics from leaking towards outside. That is, the rim of the press plate may be sealed in the inside of the outer cover 280 to be explained below, and a hole may be formed in the press plate that communicates with the diffusion portion 230, allowing the cosmetics being discharged from the sponge to be easily delivered to the discharge plate 220.

The sponge may be made of at least one selected from a group including polyamide, polyester, polyether, polyurethane, polyethylene, polystyrene, polyolefin, polyvinyl alcohol, polyamide, polypropylene, polyacryl, polyvinyl chloride, epoxy resin, sponge, nylon, cotton, non-woven fabric and etc.

Furthermore, in the present embodiment, the discharge unit 210 may be a pocket that may be elastically transformed. That is, the discharge unit 210 may be provided as a pocket of which the volume may change, and therefore the size of the discharge unit 210 may be naturally reduced when the cosmetics is being discharged. For example, the discharge unit 210 may have a shape of a balloon.

The discharge plate 220 is provided at one side of the discharge unit 210, and has at least one discharge hole 221 through which the cosmetics passes. The discharge plate 220 may be made of metal that prevents rust such as steel, stainless steel, copper, zinc, tin, aluminum, an alloy thereof, a metal plated material, etc. Especially, when plating the discharge plate 220, it is desirable to plate the discharge plate 220 with chromium, copper, silver, gold or etc. to provide corrosion resistance, stain resistance, and bacteria resistance, and also beauty and elegance, sophisticated appearance and high hygiene conditions.

Herein, the discharge plate 220 may have a thickness of 0.1 to 1 mm (preferably 0.2 mm to 0.3 mm), and include metal having excellent corrosion resistance and rust resistance, such as aluminum, aluminum alloy, stainless steel or etc., or the discharge plate 220 may include ceramics or the like.

More specifically, the discharge plate 220 may include SUS 304 among SUS 300 series having good corrosion resistance, acid resistance and heat resistance. More particularly, to improve antimicrobial resistance and hygienic conditions, the discharge plate 220 may include 30431 material.

Of course, according to the present embodiment, the material of the discharge plate 220 is not limited thereto. The discharge plate 220 may include at least one of 301L, 304L, 304LN, 304N1, 305EG, 309S, 310S, 316, 316L, 316LN, 316Ti, 317L, 321, 347, 329J3L, and 329LD including 304 series.

Therefore, according to the present embodiment, by using the discharge plate 220 made of a SUS 300 series stainless steel, the top surface of the discharge plate 220 on which the cosmetics discharged through the discharge unit 210 is placed and remain may be kept clean, and corrosion may be effectively prevented.

In addition, according to the present embodiment, by using the metallic discharge plate 220, the discharge plate 220 may efficiently dissipate heat, so that a cooling effect may be obtained to reduce the temperature of the cosmetics. This was explained with reference to the tables hereinabove.

The present embodiment may use an impregnated sponge instead of the pump 210 as mentioned above, in which case even when using a sponge, the discharge plate 220 is distanced from the sponge According to the present embodiment, as described above, an impregnated sponge may replace the pump 210. When the impregnated sponge is used, the discharge plate 220 is distanced from the sponge by the diffusion portion 230.

Therefore, since the discharge plate 220 is not in contact with the sponge continuously, even when using the sponge as the discharge unit 210, the cosmetics may be cooled by the discharge plate 220. Furthermore, since the cosmetics is discharged through the diffusion portion 230, it is possible to prevent air from being introduced into the sponge, thereby preventing contamination of the cosmetics from the first place.

The cosmetics remains on the top surface of the discharge plate 220. When the user rubs the cosmetics remaining on the top surface of the discharge plate 220 with a puff or the like, the top surface of the discharge plate 220 may wear down due to powder contained in the cosmetics. Therefore, in the present embodiment, either by manufacturing the discharge plate 220 with a material having a higher hardness than the paint included in the cosmetics or by coating or plating the top surface of the discharge plate 220 with a particular material, it is possible to prevent the durability of the discharge plate 220 from deteriorating even when the user rubs the top surface of the discharge plate 220.

The discharge plate 220 may be plated with a different metal from the metal forming the discharge plate 220. For example, the discharge plate 220 may be plated with chromium. More specifically, the discharge plate 220 may be plated with trivalent chromium or hexavalent chromium.

As described above, according to the present embodiment, the discharge plate 220 is formed of a metal material and at least one surface thereof is plated with chromium, hygiene, anti-microbial resistance and durability may be ensured. In addition, the cosmetics remaining on the discharge plate 220 may be easily cleaned to keep the discharge plate 220 clean and increase user convenience. In other words, according to the present embodiment, since a separate member is not placed on the top surface of the discharge plate 220, the top surface of the discharge plate 220 may be directly exposed to the outside.

On the discharge plate 220, at least one discharge hole 221 is provided to discharge cosmetics. Herein, the discharge hole 221 may be provided radially on the basis of the outlet 211 of the discharge unit 210. Herein, the discharge hole 211 provided radially may have a diameter that increases as it is farther away from the center of the discharge plate 220. Since the cosmetics is discharged from the center by the discharge unit 210 and is spread along the diffusion space 231, the flow rate of the cosmetics may gradually decrease from the center. Therefore, when the discharge holes 221 all have a same diameter, cosmetics may not be evenly spread over the top surface of the discharge plate 220, and thus it is desirable that the diameter of the discharge holes 221 increases as they are farther away from the center.

The discharge holes 221 may be arranged to have a certain shape besides being arranged radially. For example, the discharge holes 221 may be arranged in various formats such as a polygon and star shape, and only one discharge hole 221 may be arranged.

The discharge hole 221 may be arranged not to correspond to the outlet 211 of the discharge unit 210. This is because if the cosmetics being discharged from the discharge unit 210 is discharged directly to the discharge hole 221 via the diffusion portion 230, cosmetics having a low viscosity may splash up and cause inconvenience to the user.

The discharge hole 221 formed on the discharge plate 220 may be very small such as the diameter being 0.1 to 1 mm. Configuring the diameter of the discharge hole 221 to be small is to easily adjust the amount of the cosmetics being discharged upwards the discharge plate 220 through the discharge unit 210, and to prevent foreign material from being introduced inside through the discharge hole 221.

More specifically, the discharge plate holes 221 may be provided radially and separated from each other at 45 degree intervals on the basis of the center of the discharge plate 220. Three discharge holes 221 may be arranged next to each other in a predetermined direction away from the center of the discharge plate 220. These three discharge holes 221 arranged next to each other may sequentially have diameters of 0.3 mm, 0.4 mm, and 0.5 mm from the center of the discharge plate 220 towards the outside.

Therefore, according to the present embodiment, since the discharge plate 220 including the discharge holes 221 having the above-described very small diameters are used for the discharge unit 210 of the type of an airless pump 210, the cosmetics may be prevented from contacting air, so that some of the materials included in the cosmetics may be sufficiently prevented from being volatilized.

As described above, since the discharge holes 221 have very small diameters, when the discharge plate 220 is manufactured by injection molding, it may be difficult to accurately manufacture the discharge holes 221. Therefore, according to the present embodiment, the discharge holes 221 may be formed by etching after the discharge plate 220 is manufactured so that discharge holes 221 having a diameter of 0.1 mm may be manufactured.

The discharge plate 220 may be made of a metallic material as mentioned above. However, in low temperature environments such as winter, the cooling effect may cause inconvenience to the user. In order to resolve this problem, the discharge plate 220 may be made of at least one nonmetallic material selected from a group including plastic, wood, MDF, nonmetallic mineral, paper, silicon, ceramic, rubber, and glass.

If the cosmetics accommodated inside the cosmetic vessel 21 of the present embodiment is mainly for summer use, the discharge plate 220 may be made of a metallic material, but if the cosmetics accommodated inside the cosmetic vessel 21 of the present embodiment is mainly for winter use, the discharge plate 220 may be made of a nonmetallic material.

If the discharge plate 220 is made of a nonmetallic material, the discharge plate 220 may be made of for example at least one material selected from a group including polyurethane, polyethylene, polyester, polyether, polypropylene, polystyrene, ABS, SAN, acryl, polyimide, polycarbonate, polyethyleneterephthalate, and nylon.

In this case, it can be regarded that the discharge plate 220 of a nonmetallic material is made of a non-current-carrying material, and in the case where the user rubs a puff on the discharge plate 220 in order to apply the cosmetics exposed on the top surface of the discharge plate 220, such a discharge plate 220 made of a non-current-carrying material may prevent static electricity from being generated due to friction between the puff and the discharge plate 220. That is, since the discharge plate 220 is made of a non-current-carrying material, the discharge plate 220 may restrict generation of static electricity in the case of friction with the puff to rub the discharged cosmetics.

The discharge plate 220 may be made of a metallic material or a nonmetallic material, and on one surface such as a top surface of the discharge plate 220, a fiber material may be provided by way of flocking processing, or a thin film may be formed by coating, or an outer surface may be formed by laminating.

Besides the above, processing of the one surface of the discharge plate 220 may be realized in various ways to increase user satisfaction. That is, there is no limitation to the material of the discharge plate 220, whether or not to process the one surface, processing method, or processing material. That is, the discharge plate 220 of the present embodiment may include the descriptions explained for the discharge plate 150 in the aforementioned first to ninth embodiments.

At one side of the discharge plate 220, a coupling hole 222 may be formed. Herein, the coupling hole 222 may be engaged with the coupling protrusion 236 of the diffusion portion 230, and the discharge plate 220 may be mounted onto the diffusion portion 230 as the coupling hole 222 and coupling protrusion 236 engage each other.

The purpose of using the coupling hole 222 and coupling protrusion 236 is to limit the angle at which the discharge plate 220 is mounted. That is, in order for the discharge hole 221 formed on the discharge plate 220 to communicate with the diffusion space 231 formed on the diffusion portion 230, the angle at which the discharge plate 220 is placed must be limited in terms of structure.

Of course, unlike as mentioned above, the coupling protrusion 236 may be provided on the discharge plate 220, and the coupling hole 222 may be formed on the diffusion portion 230, or other various well known structures may be used to limit the angle at which the discharge plate 220 is mounted. However, even if the angle at which the discharge plate 220 is mounted is changed, if there is no discharge of cosmetics, that is, if the discharge hole 221 of the discharge plate 220 is arranged in a circular shape and the diffusion space 231 also has a circular shape, the coupling hole 222 and coupling protrusion 236 may be omitted.

The diffusion portion 230 is provided with the diffusion space 231 between the discharge plate 220 and discharge unit 210 for delivering the cosmetics discharged from the discharge unit 210 to the discharge hole 221. The diffusion portion 230 is a component for distancing the discharge plate 220 and discharge unit 210 from each other, and serves to deliver the cosmetics discharged from one outlet 211 to each of a plurality of discharge holes 221. For this purpose, the diffusion space 231 and the outlet 211 of the discharge unit 210 may be communicated by a communicating hole 232.

The diffusion portion 230 allows the cosmetics being discharged from the outlet 211 of the discharge unit 210 to be evenly delivered to the discharge hole 221. Herein, the size of the discharge holes 221 may increase as they are farther away from the outlet 211 of the discharge unit 210, and thus sufficient amount of cosmetics may be discharged to each discharge hole 221 via the diffusion space 231.

Furthermore, the height of the diffusion space 231 may decrease towards the outer direction, so that cosmetics may be easily delivered to the discharge holes 221 arranged on the outer side. That is, the diffusion space 231 may be inclined upwardly towards the outer side.

The cosmetics is accommodated inside the discharge unit 210, and since the cosmetics is isolated from outside except for the outlet 211, contamination is minimized. Furthermore, although the cosmetics being discharged on the top surface of the discharge plate 220 will contact air and thus may be contaminated, such cosmetics will be used by the user within a short period of time, and thus contamination is not a problem. However, the cosmetics accommodated inside the diffusion space 231 of the diffusion portion 230 may be a problem. That is because the cosmetics accommodated inside the diffusion space 231 has a high possibility of contacting air compared to the cosmetics accommodated in the discharge unit 210.

However, the present embodiment may minimize the cosmetics remaining in the diffusion portion 230, thereby preventing contamination of the cosmetics. For this purpose, the diffusion portion 230 may have a close contact surface 240 to be explained below on areas beside the diffusion space 231.

The diffusion portion 230 may closely contact the discharge plate 220 through the close contact surface 240 by surface contact. Herein, the portion in close contact is an upper surface of the diffusion portion 230, and may be an outer portion of the diffusion space 231. This is to distance only the diffusion space 231 from the discharge plate 220, but leaving all the remaining areas to be in close contact with the discharge plate 220, thereby preventing the cosmetics from leaking towards the outside of the diffusion space 231.

In this case, the cosmetics will remain only in the diffusion space 231, and thus the cosmetics will not remain on the upper surface of the diffusion portion 230, thereby minimizing the residual amount of the cosmetics. Therefore, in the present embodiment, user satisfaction is significantly improved.

The close contact surface 240 is in close contact with the discharge plate 220. The close contact surface 240 is provided on the upper surface of the diffusion portion 230 and is in close contact with a lower surface of the discharge plate 220. Thus, the close contact surface 240 closely contacts the diffusion portion 230 and the discharge plate 220. For this purpose, on the upper surface of the diffusion portion 230, a space may be provided for the mounting of the close contact surface 240. Herein, the space refers to the space between the diffusion space 231 and the lower surface of the discharge plate 220.

In order to prevent the close contact surface 240 from being pushed towards the outside and to maintain the position of the close contact surface 240, a rim protrusion 233 may be provided in the diffusion portion 230. At least one rim protrusion 233 may protrude in the shape of an arc or ring along the rim of the close contact surface 240 on the upper surface of the diffusion portion 230 to surround the rim of the close contact surface 240.

The close contact surface 240 is provided on the outside of the diffusion space 231. The close contact surface 240 closely contacts the discharge plate 220 to the diffusion portion 230, but may distance only the diffusion space 231 from the discharge plate 220 to allow introduction of the cosmetics. That is, the close contact surface 240 may be provided on the outside of the diffusion space 231 to place the diffusion portion 230 and the discharge plate 220 in close contact to each other in the areas other than the diffusion space 231, thereby preventing the cosmetics from leaking from the first place.

The close contact surface 240 may be provided in a thin plate shape, and may be formed integrally with the diffusion portion 230 on one surface of the diffusion portion 230. However, the close contact surface 240 may have a smaller thickness than the diffusion portion 230, but a relatively greater thickness than the discharge plate 220.

The close contact surface 240 may be made of a material of high friction force so as to maintain a firm contact between the diffusion portion 230 and discharge plate 220. For example, the close contact surface 240 may be made of a variety of materials such as a fiber material, foam resin, etc. Herein, the close contact surface 240 may be of a different material from the diffusion portion 230, in which case the close contact surface 240 may be provided on the diffusion portion 230 by double injection molding.

The close contact surface 240 may be made of foam resin or etc, but the size of a cell may be small so as not to allow introduction of cosmetics. It is because that if the cosmetics is impregnated by the close contact surface 240, the sealing by the close contact surface 240 may not be properly made.

The close contact surface 240 may be formed integrally with the diffusion portion 230, or may be formed separately and be mounted on the upper surface of the diffusion portion 230. That is, the close contact surface 240 and diffusion portion 230 may be manufactured at the same time or separately. In the case of manufacturing the close contact surface 240 and diffusion portion 230 separately, the close contact surface 240 may be adhered to the diffusion portion 230 using a well known adhesive, or be fixated using other various well known coupling structures.

The close contact surface 240 is provided on the outside of the diffusion space 231 to place the outside of the diffusion space 231 in close contact to the discharge plate 220, wherein in order to avoid covering the diffusion space 231, the portion in the close contact surface corresponding to the diffusion space 231 may have a through hole shape. In this case, the through hole portion formed on the close contact surface 240, that is, the diffusion hole 241 may be in communication with the diffusion space 231.

Otherwise, the portion in the close contact surface 240 corresponding to the discharge hole 221 of the discharge plate 220 may have a through hole shape, in which case the diffusion hole 241 may have a shape similar to or different from that of the diffusion space 231. However, it is desirable that the diffusion hole 241 is arranged at least not to block the discharge hole 221.

The packing material 250 is provided on the outside of the diffusion space 231 to prevent the cosmetics from leaking. The diffusion portion 230 may be provided with a packing groove 234 for the mounting of the packing material 250. The packing groove 234 may be arranged to surround the diffusion space 231.

For example, the packing groove 234 of the diffusion portion 230 may have the shape of a flower or ring. The shape of the packing material 250 may be determined by the shape of the packing groove 234. Herein, the packing material 250 may be configured in a one piece structure, or as an assembly of one or more separable components.

The packing material 250 may be made of a compressible material such as rubber. Since the packing groove 234 having the packing material 250 is on the outside of the diffusion space 231, on the upper surface of the packing material 250, the close contact surface 240 may be arranged.

Therefore, the packing material 250 may be compressed by the close contact surface 240, and together with the close contact surface 240, the packing material 250 may prevent the cosmetics from leaking. Especially, the packing material 250 may have a relatively higher height than the packing groove 234, and thus the packing material 250 mounted on the packing groove 234 may push up the close contact surface 240, whereby the close contact between the close contact surface 240 and discharge plate 220 may be firmly maintained.

A packing material 260 is provided on the outside of the close contact surface 240. The packing material 250 is provided on the lower portion of the close contact surface, whereas the packing material 260 is provided on the outside of the close contact surface 240 to realize a dual close contact. That is, the packing material 250 realizes a dual close contact in an upward and downward direction, whereas the packing material 260 realizes a dual close contact in an inward and outward direction.

The packing material 260 may be provided in a same or similar shape as the aforementioned packing material 250, and may be made of a same or similar material as the aforementioned packing material 250. However, the packing material 260 may have a wider width than the packing material 250.

In order to mount the packing material 260, a packing groove 235 may be formed on the discharge plate 220. Herein, the packing groove 235 may be provided on the outside of the packing groove 234. Furthermore, the packing groove 234 is for providing the packing material 250 on the lower portion of the close contact surface 240, whereas the packing groove 235 is for providing the packing material 260 on the outside of the close contact surface 240, and thus the packing groove 235 may be positioned in an upper location than the packing groove 234. Herein, the difference of height between the two packing grooves 234, 235 may depend on the thickness of the close contact surface 240.

The rim portion 270 is coupled to the rim of the discharge plate 220. The rim portion 270 is a component for allowing the discharge plate 220 to ascend and descend based on the outer cover 280 to be explained below. The rim portion 270 may include an inner rim portion 271 and an outer rim portion 272.

The inner rim portion 271 may surround the rim of the discharge plate 220 while fixating the discharge plate 220. Herein, the inside of the inner rim portion 271 may have a through hole shape so as to expose the discharge plate 220, thereby exposing the cosmetics discharged on the top surface of the discharge plate 220.

The inner rim portion 271 may be manufactured integrally with the discharge plate 220. This is because of the structure configured such that the discharge plate 220 descends as the inner rim 271 descends. In this case, the material of the inner rim portion 271 may be the same or similar with the material of the discharge plate 220, for example, a metallic material such as steel, stainless steel, copper, zinc, tin, aluminum, an alloy thereof, or a metallic material plated therewith, or a nonmetallic material, etc. Furthermore, the inner rim portion 271 may be plated with a metallic material such as chromium, copper, silver, gold and the like in a similar manner with the discharge plate 220 to provide effects of beautiful appearance and improved durability.

The inner rim portion 271 may have a shape of its height gradually increasing as it is farther away from the rim of the discharge plate 220. This is to avoid the inner rim portion 271 from acting as an obstacle to the user when rubbing the discharge plate 220 with a puff, and to prevent the cosmetics from leaking.

An outer rim portion 272 is provided on the outside of the inner rim portion 271. The outer rim portion 272 may be coupled to an outer cover 280. However, the outer rim portion 272 is not fixated to the inner rim portion 271, and the outer rim portion 272 may surround the outside of the inner rim portion 271 while allowing the inner rim portion 271 to ascend and descend. For this purpose, a protrusion 2711 is formed on the outer surface of the inner rim portion 271, and a groove 2721 corresponding to the protrusion 2711 of the inner rim portion 271 is formed on the inner surface of the outer rim portion 272, and therefore the outer rim portion 272 may limit rotation of the inner rim portion 271 but allow ascending and descending of the inner rim portion 271.

A portion on the side of the outer rim portion 272 where a latch 2822 of a latching portion 282 to be explained below is provided may be recessed or opened in order to avoid interference between components when assembled.

The outer rim portion 272 may be coupled to the outer cover 280, and the inner rim portion 271 may ascend and descend on the basis of the outer rim portion 272 to operate the discharge unit 210. That is, when the user grips the outer cover 280 and presses the discharge plate 220 on the inner side of the inner rim portion 271 with a puff (not illustrated), the inner rim portion 271 coupled to the discharge plate 220 in the inner side of the outer rim portion 272 coupled to the outer cover 280 will descend, thereby operating the discharge unit 210 to provide the cosmetics to the top surface of the discharge plate 220 and to the inside of the inner rim portion 271. Therefore, the user becomes able to pick up the cosmetics exposed on the top surface of the discharge plate 220 with a puff and the like and apply it on skin.

However, in the present embodiment, the discharging of cosmetics by the discharge unit 210 may be realized through a button structure (not illustrated) separately provided on the outside of the discharge plate 220 instead of the inner rim portion 271. Herein, the button structure may be a button structure of a generally known lever method wherein the outlet 211 of the airless pump 210 may be pressed to discharge the cosmetics. In such a case, the inner rim portion 271 may be provided to allow the discharge plate 220 to ascend and descend inside.

The outer cover 280 is configured to surround the discharge unit 210. The outer cover 280 has a space in which the discharge unit 210 is mounted. However, an opening 281 may be formed on a lower part of the outer cover 280 to expose the discharge unit 210. The user pushes up the discharge unit 210 through the opening 281 of the outer cover 280 to separate the discharge unit 210 therefrom, so that the discharge unit 210 may be replaced with a new one.

The upper surface of the outer cover may be covered, from the exterior towards the center, by the outer rim portion 272, inner rim portion 271, and discharge plate 220, sequentially. Therefore, the present embodiment improves the appearance, and therefore user satisfaction since the user cannot see the discharge unit 210 from outside.

The outer cover 280 may include the latching portion 282. The latching portion 282 may be coupled to the lid 290 to prevent the lid 290 from opening. The outer cover 280 may include a button 2821 and a latch 2822 formed in a single body. In other words, when the user pushes the button 2821, the latch 2822 also moves in a direction in which the button 2821 is pressed. In this manner, the latching portion 282 may control opening and closing of the lid 290 by separating the latch 2822 from the lid 290.

The outer cover 280 may include the latching portion 282. The latching portion 282 may be coupled to the lid 290 to prevent the lid 290 from opening. A button 2821 and a latch 2822 may be formed in a single body. In other words, when the user pushes the button 2821, the latch 2822 also moves in a direction in which the button 2821 is pressed. In this manner, the latching portion 282 may control opening and closing of the lid 290 by separating the latch 2822 from the lid 290.

The lid 290 opens and closes one side of the outer cover 280 (herein, upper side). One side of the lid 290 may be coupled to the outer cover 280 using a hinge. The lid 290 may rotate on the basis of the center of the hinge to open the upper side of the outer cover 280. The lid 290 may be fixed with it sealing the upper side of the outer cover 280 by the latching portion 282.

The lid 290 may be coupled to the outer cover 280 using the hinge. A spring may be provided on the hinge structure so that the lid 290 may be automatically opened when the lid 290 is released from the latching portion 282.

A mirror 291 may be provided in the inside of the lid 290. While the user looks into the mirror 291 after opening the lid 290, the user may discharge the cosmetics from the discharge unit 210 by pressurizing the discharge plate 220 or the inner rim portion 271, and use the cosmetics.

As described above, in the present embodiment, the discharge plate 220 and diffusion portion 230 are in close surface contact to each other so that the cosmetics flowing along the diffusion space 231 does not leak outside the diffusion space 231, thereby preventing wasting of the cosmetics from the first place, and keeping the cosmetics only in the diffusion space 231 and minimizing the remaining amount.

Figure 27:
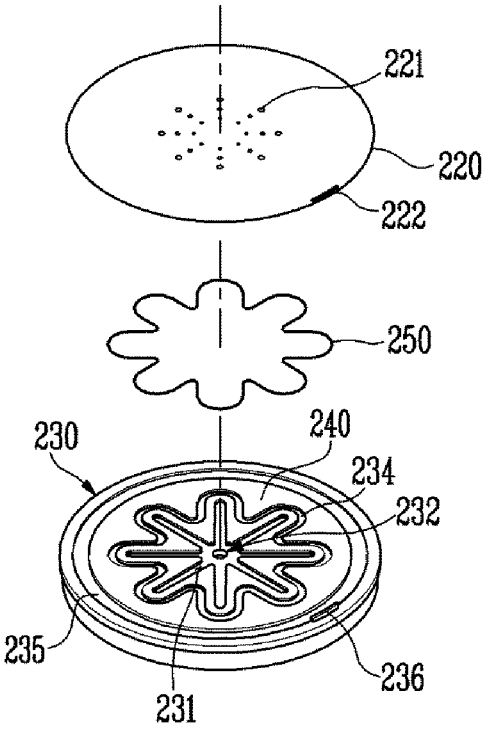
FIG. 27 is an exploded perspective view of a cosmetic vessel according to the eleventh embodiment of the present disclosure.
Figure 32:
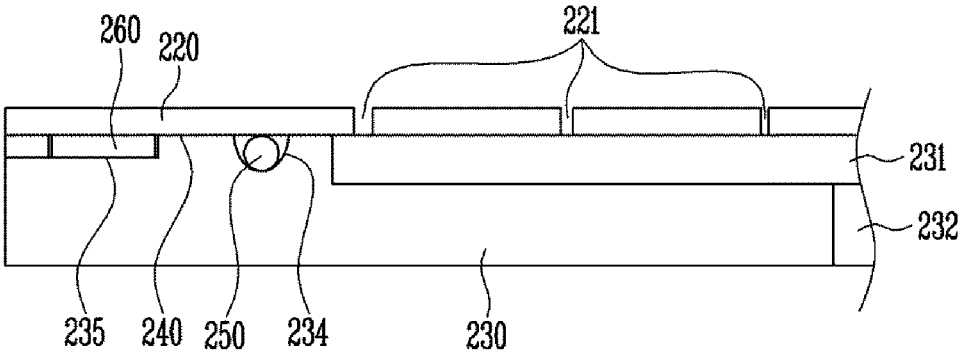
FIG. 32 is a partial cross-sectional view of a cosmetic vessel according to the eleventh embodiment of the present disclosure.

FIG. 27 is an exploded cross-sectional view of a cosmetic vessel according to an eleventh embodiment of the present disclosure, and FIG. 32 is a partial cross-sectional view of a cosmetic vessel according to the eleventh embodiment of the present disclosure.

Hereinafter, the eleventh embodiment of the present disclosure will be explained with reference to FIGS. 27 and 32 together with FIGS. 24 and 25.

Referring to FIGS. 24 to 25 and FIGS. 27 and 32, in the eleventh embodiment, an upper surface of the diffusion portion 230 may substitute for the close contact surface 240. That is, instead of using the close contact surface 240, the diffusion portion 230 may directly closely contact the upper surface to the lower surface of the discharge plate 220.

However, in such a case, it is necessary to secure sufficient frictional force and sealing force between one surface of the diffusion portion 230 and one surface of the discharge plate 220, and thus the upper surface of the diffusion portion 230 may be subjected to a subsequent processing for improving the frictional force.

Herein, the subsequent processing may be a flocking process for forming a fiber material, or a coating process for improving the surface roughness. Besides these, other types of subsequent processing may be performed on the upper surface of the diffusion portion 230. That is, there is no limitation to the subsequent processing that may be applied to the upper surface of the diffusion portion 230 as long as it aims at improving the frictional force and sealing force of the upper surface of the diffusion portion 230.

Unlike in the tenth embodiment where the close contact surface 240 is adhered to, structurally coupled to, or integrally formed with the upper surface of the diffusion portion 230, in the present embodiment, the upper surface of the diffusion portion 230 itself acts as the close contact surface 240, thereby reducing one step in the manufacturing process. Therefore, it is possible to reduce the manufacturing cost.

Thus, according to the present embodiment, by omitting a component as aforementioned, the thickness from the lower surface of the discharge plate 220 to the lower surface of the diffusion portion 230 may be reduced, thereby reducing the overall thickness of the cosmetic vessel 21. However, as the upper surface of the diffusion portion 230 acts as the close contact surface 240, the packing material 250 may perform a separate close contact with the close contact surface 240.

In other words, when seen from the inside to the outside in a cross-sectional view, the close contact may be made in four layers by the close contact surface 240 which is the upper surface of the diffusion portion 230, the packing material 250, the close contact surface 240 which is the upper surface of the diffusion portion 230 formed on the outside of the packing material 250, and the other packing material 260. However, in the present embodiment, a dual close contact is not realized in an upward and downward direction.

As aforementioned, in the present embodiment, the upper surface of the diffusion portion 230 is subjected to a subsequent processing such that the upper surface of the diffusion portion 230 may act as the close contact surface 240, thereby preventing the cosmetics from leaking outside of the diffusion space 231 and further simplifying the configuration and saving the manufacturing cost.

Figure 28:
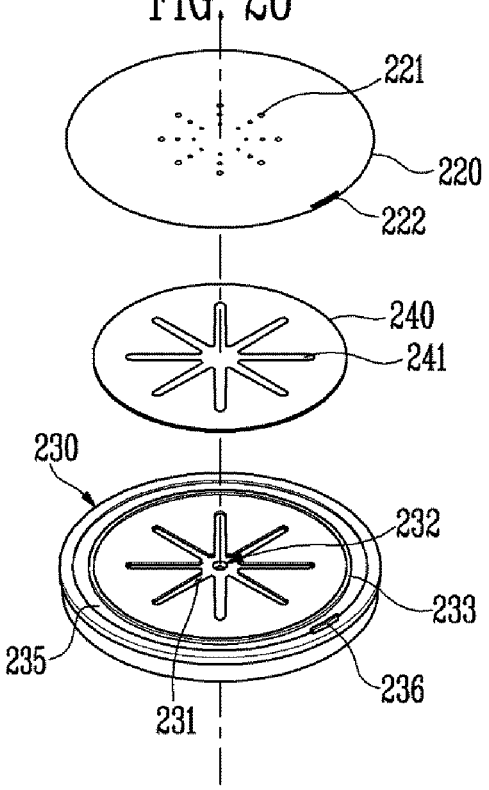
FIG. 28 is an exploded perspective view of a cosmetic vessel according to the twelfth embodiment of the present disclosure.
Figure 33:
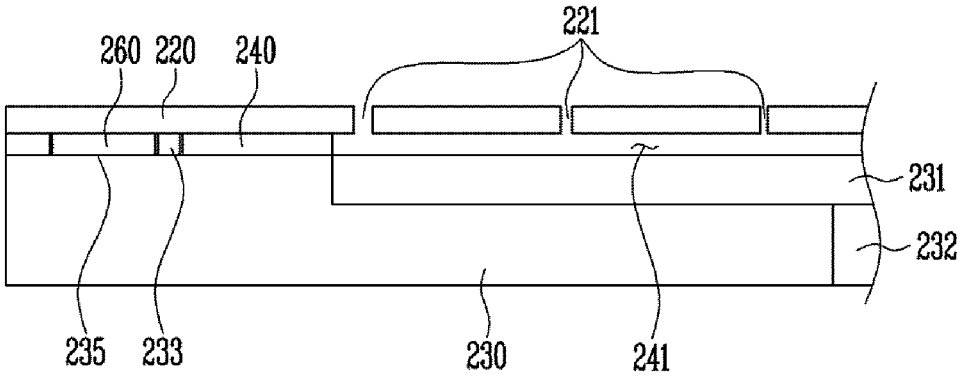
FIG. 33 is a partial cross-sectional view of a cosmetic vessel according to the twelfth embodiment of the present disclosure.

FIG. 28 is an exploded perspective view of a cosmetic vessel according to a twelfth embodiment of the present disclosure, and FIG. 33 is a partial cross-sectional view of a cosmetic vessel according to the twelfth embodiment of the present disclosure.

Referring to FIGS. 24 and 25 together with FIGS. 28 and 33, the packing material 250 and packing groove 234 may be omitted from the cosmetic vessel 21 according to the twelfth embodiment of the present disclosure, unlike in the tenth embodiment of the present disclosure. This is because sufficient sealing force by the close contact surface 240 may be secured in the present embodiment.

In other words, in the present embodiment, sealing is realized using the close contact surface 240, but as the packing material 250 on the lower portion of the close contact surface 240 is omitted, the configuration is simplified and thus the manufacturing cost is reduced. The configuration of the present embodiment is the same as the tenth embodiment besides the fact that the packing material 250 and packing groove 234 are omitted, and thus further explanation will be omitted.

Figure 29:
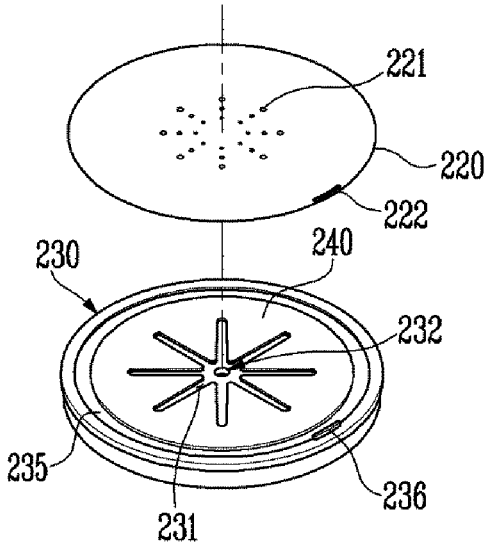
FIG. 29 is an exploded perspective view of a cosmetic vessel according to the thirteenth embodiment of the present disclosure.
Figure 34:
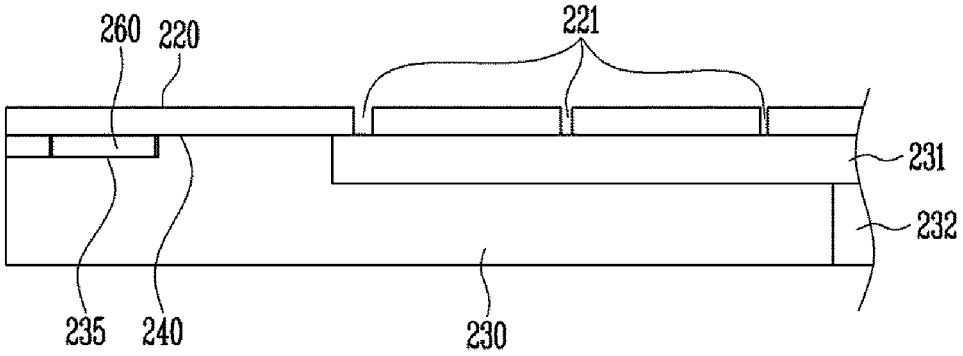
FIG. 34 is a partial cross-sectional view of a cosmetic vessel according to the thirteenth embodiment of the present disclosure.

FIG. 29 is an exploded perspective view of a cosmetic vessel according to a thirteenth embodiment of the present disclosure, and FIG. 34 is a partial cross-sectional view of a cosmetic vessel according to the thirteenth embodiment of the present disclosure.

Referring to FIGS. 24 and 25 together with FIGS. 29 and 34, in the cosmetic vessel 21 according to the thirteenth embodiment, the packing material 250 and packing groove 234 may be omitted, unlike in the eleventh embodiment of the present disclosure. Explanation on omitting the packing material 250 and packing groove 234 is the same as in the twelfth embodiment, and thus further explanation will be omitted. Other than that, the configuration is the same as in the eleventh embodiment, and thus detailed explanation will be omitted as well.

Figure 30:
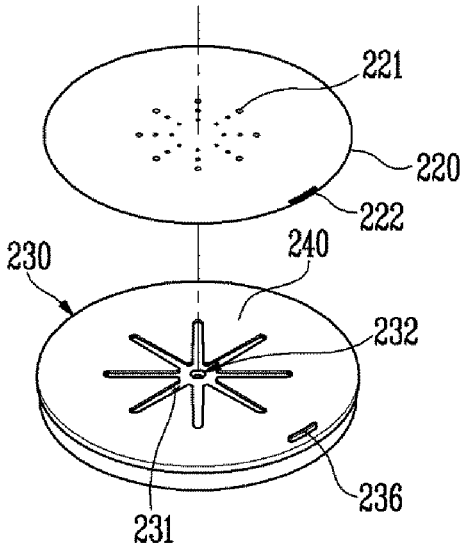
FIG. 30 is an exploded perspective view of a cosmetic vessel according to the fourteenth embodiment of the present disclosure.
Figure 35:
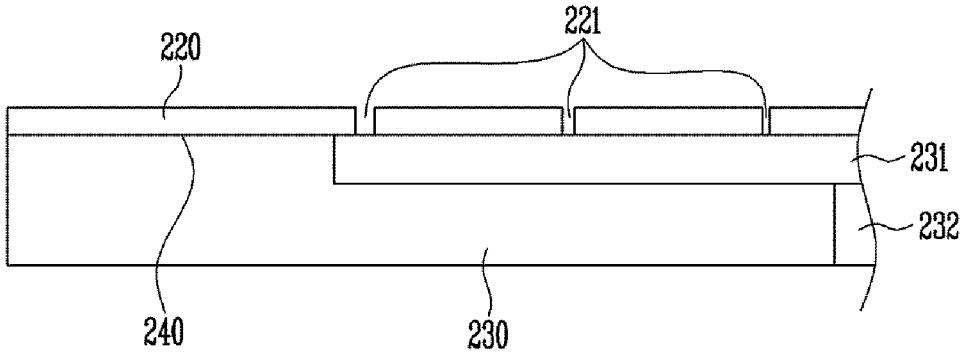
FIG. 35 is a partial cross-sectional view of a cosmetic vessel according to the fourteenth embodiment of the present disclosure.

FIG. 30 is an exploded perspective view of a cosmetic vessel according to a fourteenth embodiment of the present disclosure, and FIG. 35 is a partial cross-sectional view of a cosmetic vessel according to the fourteenth embodiment of the present disclosure.

Referring to FIGS. 24 and 25 together with FIGS. 30 and 35, in the cosmetic vessel 21 according to the fourteenth embodiment of the present disclosure, the packing material 260 provided on the outside is further omitted, unlike in the thirteenth embodiment.

In other words, in the present embodiment, the upper surface of the diffusion portion 230 forms the close contact surface 240, and the discharge plate 220 and diffusion portion 230 make a close surface contact to each other through the close contact surface 240 so as to secure sealing force, and both packing materials 250, 260 are omitted, and therefore the configuration is simplified.

Therefore, the present embodiment provides an effect of innovatively saving the manufacturing cost while preventing the cosmetics from leaking through the sealing force by the close contact surface 240. Furthermore, the present embodiment may improve user satisfaction and portability by reducing the weight or size.

However, when the packing materials 250, 260 are omitted, the sealing force may deteriorate, but in the present embodiment, the subsequent processing on the upper surface of the diffusion portion 230 may be performed differently when compared to other aforementioned embodiments. That is, the subsequent processing may be performed such that it improves the sealing force of the close contact surface 240 that is the upper surface of the diffusion portion 230.

This also applies to the other aforementioned embodiments. That is, in preparation for the deterioration of the sealing force that may occur when the packing materials 250, 260 are omitted, a surface roughness or subsequent method on the close contact surface 240, or a subsequent method on the upper surface of the diffusion portion 230 in the case where the upper surface of the diffusion portion 230 directly forms the close contact surface 240 may be applied depending on the embodiments.

In the drawings and specification, there have been disclosed typical exemplary embodiments of the invention, and although specific terms are employed, they are used in a generic and descriptive sense only and not for purposes of limitation. As for the scope of the invention, it is to be set forth in the following claims. Therefore, it will be understood by those of ordinary skill in the art that various changes in form and details may be made therein without departing from the spirit and scope of the present invention as defined by the following claims.

What is claimed is:

1. A cosmetic vessel comprising:

a discharge unit discharging cosmetics to an outside; and a discharge plate provided at one side of the discharge unit from which the cosmetics are discharged, the discharge plate including a plurality of discharge holes, wherein the cosmetics are discharged through the plurality of discharge holes of the discharge plate, and a thin film is formed on one surface of the discharge plate exposed to the outside, wherein the discharge unit is an airless pump for discharging the cosmetics received therein to an outlet of the discharge unit by using a piston moving up and down in a cylinder, wherein the cosmetics are discharged from the airless pump as the discharge plate is pressed, wherein a plurality of holes communicating with the plurality of discharge holes are formed on the thin film, and wherein the plurality of holes of the thin film and the plurality of discharge holes communicating with each other have a same diameter.

2. The cosmetic vessel of claim 1, wherein the thin film covers portions between the plurality of discharge holes at one surface of the discharge plate.

3. The cosmetic vessel of claim 1, wherein the thin film includes the holes communicating with the plurality of discharge holes so that the cosmetics are discharged therethrough.

4. The cosmetic vessel of claim 1, wherein the thin film has a smaller thickness than the discharge plate.

5. The cosmetic vessel of claim 1, wherein the thin film has a thickness ranging from 1 micrometer to 50 micrometers.

6. The cosmetic vessel of claim 1, wherein the thin film comprises at least one material selected from a group including gold, silver, bronze, copper, chromium, and hologram.

7. The cosmetic vessel of claim 6, wherein the discharge plate is made of a nonmetallic material.

8. The cosmetic vessel of claim 1, wherein the cosmetics are discharged from the discharge unit by pressurizing the discharge plate.

9. The cosmetic vessel of claim 1, further comprising an outer plate provided at one surface of the discharge plate from which the cosmetics are discharged through the plurality of discharge holes.

10. The cosmetic vessel of claim 9, wherein the outer plate includes a hole communicating with the plurality of discharge holes so that the cosmetics are discharged therethrough.

11. The cosmetic vessel of claim 1, wherein the plurality of discharge holes are misaligned with the outlet of the discharge unit.

12. The cosmetic vessel of claim 1, further comprising:

a diffusion portion provided between the discharge unit and the discharge plate and distributing the cosmetics to the plurality of discharge holes; and a rim portion moving downwards in conjunction with the discharge plate while fixing the discharge plate and the diffusion portion.

13. The cosmetic vessel of claim 12, wherein the rim portion surrounds a rim of the discharge plate and is coupled to the diffusion portion.

14. The cosmetic vessel of claim 12, wherein the rim portion is provided integrally with the discharge plate.

15. The cosmetic vessel of claim 12, wherein the diffusion portion includes a packing material for preventing the cosmetics from being leaked to an outside of the diffusion portion.

16. The cosmetic vessel of claim 12, wherein the rim portion comprises:

an inner rim portion moving downwards in conjunction with the discharge plate while fixing the discharge plate and the diffusion portion; and an outer rim portion provided on an outside of the inner rim portion, and wherein the outer rim portion restricts rotation of the inner rim portion, allows elevating and lowering thereof, and surrounds the outside of the inner rim portion.

17. The cosmetic vessel of claim 16, wherein teeth are formed on an inner surface of the outer rim portion and an outer surface of the inner rim portion to restrict the rotation of the inner rim portion and allow the elevating and lowering thereof.

18. The cosmetic vessel of claim 1, wherein the thin film is laminated in a plurality of layers on the one surface of the discharge plate.

19. The cosmetic vessel of claim 18, wherein the plurality of layers of the thin film have different appearances.

20. The cosmetic vessel of claim 1, wherein the thin film is a sticker film attached to the one surface of the discharge plate in a removable manner.

21. The cosmetic vessel of claim 1, wherein the diameters of the plurality of holes of the thin film are progressively larger further away from a center of the discharge plate, and wherein the diameters of the plurality of discharge holes are progressively larger further away from a center of the discharge plate.

22. The cosmetic vessel of claim 1, wherein an outer surface of the discharge plate with the thin film formed thereon is made of a non-current-carrying material to prevent static electricity from being generated in a case of friction with a puff to rub the discharged cosmetics.

23. The cosmetic vessel of claim 1, wherein the thin film is laminated in a plurality of layers on the one surface of the discharge plate.

24. The cosmetic vessel of claim 23, wherein the layers of the thin film laminated on the one surface of the discharge plate have different appearances.

25. The cosmetic vessel of claim 1, wherein a color, a pattern or a character of an outer surface of the discharge plate is changed by laminating the thin film on the one surface of the discharge plate.

26. The cosmetic vessel of claim 1, wherein the thin film is provided in a removable manner to the one surface of the discharge plate.

27. The cosmetic vessel of claim 1, wherein the thin film is a sticker film attached to the one surface of the discharge plate.

28. The cosmetic vessel of claim 1, wherein a pattern is provided on the one surface of the thin film exposed to the outside.

29. The cosmetic vessel of claim 1, wherein an identifying element is illustrated on the thin film to indicate lamination of the thin film on the one surface of the discharge plate.

* * * * *